US010994528B1

(12) United States Patent
Burkatovsky

(10) Patent No.: US 10,994,528 B1
(45) Date of Patent: May 4, 2021

(54) DIGITAL PRINTING SYSTEM WITH FLEXIBLE INTERMEDIATE TRANSFER MEMBER

(71) Applicant: LANDA CORPORATION LTD., Rehovot (IL)

(72) Inventor: Vitaly Burkatovsky, Rishon Lezion (IL)

(73) Assignee: LANDA CORPORATION LTD., Rehovot (IL)

( * ) Notice: Subject to any disclaimer, the term of this patent is extended or adjusted under 35 U.S.C. 154(b) by 0 days.

(21) Appl. No.: 16/512,915

(22) Filed: Jul. 16, 2019

Related U.S. Application Data

(60) Provisional application No. 62/713,632, filed on Aug. 2, 2018.

(51) Int. Cl.
*B41J 2/045* (2006.01)
*B41J 2/005* (2006.01)

(52) U.S. Cl.
CPC ..... *B41J 2/04508* (2013.01); *B41J 2/0057* (2013.01); *B41J 2/04586* (2013.01)

(58) Field of Classification Search
CPC ..... B41J 2/0057
See application file for complete search history.

(56) References Cited

U.S. PATENT DOCUMENTS 2,839,181 A 6/1958 Renner
3,011,545 A 12/1961 Welsh et al.
3,053,319 A 9/1962 Cronin et al.
3,697,551 A 10/1972 Thomson
3,697,568 A 10/1972 Boissieras et al.
3,889,802 A 6/1975 Jonkers et al.
3,898,670 A 8/1975 Erikson et al.
3,947,113 A 3/1976 Buchan et al.
4,009,958 A 3/1977 Kurita et al.
4,093,764 A 6/1978 Duckett et al.
(Continued)

FOREIGN PATENT DOCUMENTS

CN 1121033 A 4/1996
CN 1200085 A 11/1998
(Continued)

OTHER PUBLICATIONS

CN101073937A Machine Translation (by EPO and Google)—published Nov. 21, 2007; Werner Kaman Maschinen GMBH & [DE].
(Continued)

*Primary Examiner* — Shelby L Fidler
(74) *Attorney, Agent, or Firm* — Momentum IP; Marc Van Dyke

(57) ABSTRACT

Methods for printing using printing systems comprising a flexible intermediate transfer member (ITM) disposed around a plurality of guide rollers at which encoders are installed, and an image-forming station at which ink images are formed by droplet deposition by print bars onto the ITM, can include measuring a local velocity of the ITM under one of the print bars, determining a stretch factor for a portion of the ITM based on a relationship between an estimated stretched length fixed physical distance between print bars, controlling an ink deposition parameter according to the stretch factor so as to compensate for stretching of the reference portion of the ITM.

9 Claims, 11 Drawing Sheets

(56) References Cited

U.S. PATENT DOCUMENTS 4,293,866 A 10/1981 Takita et al.
4,401,500 A 8/1983 Hamada et al.
4,535,694 A 8/1985 Fukuda
4,538,156 A 8/1985 Durkee et al.
4,555,437 A 11/1985 Tanck
4,575,465 A 3/1986 Viola
4,642,654 A 2/1987 Toganoh et al.
4,853,737 A 8/1989 Hartley et al.
4,976,197 A 12/1990 Yamanari et al.
5,012,072 A 4/1991 Martin et al.
5,039,339 A 8/1991 Phan et al.
5,062,364 A 11/1991 Lewis et al.
5,075,731 A 12/1991 Kamimura et al.
5,099,256 A 3/1992 Anderson
5,106,417 A 4/1992 Hauser et al.
5,128,091 A 7/1992 Agur et al.
5,190,582 A 3/1993 Shinozuka et al.
5,198,835 A 3/1993 Ando et al.
5,246,100 A 9/1993 Stone et al.
5,264,904 A 11/1993 Audi et al.
5,305,099 A 4/1994 Morcos
5,333,771 A 8/1994 Cesario
5,349,905 A 9/1994 Taylor et al.
5,352,507 A 10/1994 Bresson et al.
5,365,324 A 11/1994 Gu et al.
5,406,884 A 4/1995 Okuda et al.
5,471,233 A 11/1995 Okamoto et al.
5,532,314 A 7/1996 Sexsmith
5,552,875 A 9/1996 Sagiv et al.
5,575,873 A 11/1996 Pieper et al.
5,587,779 A 12/1996 Heeren et al.
5,608,004 A 3/1997 Toyoda et al.
5,613,669 A 3/1997 Grueninger
5,614,933 A 3/1997 Hindman et al.
5,623,296 A 4/1997 Fujino et al.
5,642,141 A 6/1997 Hale et al.
5,660,108 A 8/1997 Pensavecchia
5,677,719 A 10/1997 Granzow
5,679,463 A 10/1997 Visser et al.
5,698,018 A 12/1997 Bishop et al.
5,723,242 A 3/1998 Woo et al.
5,733,698 A 3/1998 Lehman et al.
5,736,250 A 4/1998 Heeks et al.
5,772,746 A 6/1998 Sawada et al.
5,777,576 A 7/1998 Zur et al.
5,777,650 A 7/1998 Blank
5,841,456 A 11/1998 Takei et al.
5,859,076 A 1/1999 Kozma et al.
5,880,214 A 3/1999 Okuda
5,883,144 A 3/1999 Bambara et al.
5,883,145 A 3/1999 Hurley et al.
5,884,559 A 3/1999 Okubo et al.
5,889,534 A 3/1999 Johnson et al.
5,891,934 A 4/1999 Moffatt et al.
5,895,711 A 4/1999 Yamaki et al.
5,902,841 A 5/1999 Jaeger et al.
5,923,929 A 7/1999 Ben et al.
5,929,129 A 7/1999 Feichtinger
5,932,659 A 8/1999 Bambara et al.
5,935,751 A 8/1999 Matsuoka et al.
5,978,631 A 11/1999 Lee
5,978,638 A 11/1999 Tanaka et al.
5,991,590 A 11/1999 Chang et al.
6,004,647 A 12/1999 Bambara et al.
6,009,284 A 12/1999 Weinberger et al.
6,024,018 A 2/2000 Darel et al.
6,024,786 A 2/2000 Gore
6,025,453 A 2/2000 Keller et al.
6,033,049 A 3/2000 Fukuda
6,045,817 A 4/2000 Ananthapadmanabhan et al.
6,053,438 A 4/2000 Romano, Jr. et al.
6,055,396 A 4/2000 Pang
6,059,407 A 5/2000 Komatsu et al.
6,071,368 A 6/2000 Boyd et al.
6,072,976 A 6/2000 Kuriyama et al.
6,078,775 A 6/2000 Arai et al.
6,094,558 A 7/2000 Shimizu et al.
6,102,538 A 8/2000 Ochi et al.
6,103,775 A 8/2000 Bambara et al.
6,108,513 A 8/2000 Landa et al.
6,109,746 A 8/2000 Jeanmaire et al.
6,132,541 A 10/2000 Heaton
6,143,807 A 11/2000 Lin et al.
6,166,105 A 12/2000 Santilli et al.
6,195,112 B1 2/2001 Fassler et al.
6,196,674 B1 3/2001 Takemoto
6,213,580 B1 4/2001 Segerstrom et al.
6,214,894 B1 4/2001 Bambara et al.
6,221,928 B1 4/2001 Kozma et al.
6,234,625 B1 5/2001 Wen
6,242,503 B1 6/2001 Kozma et al.
6,257,716 B1 7/2001 Yanagawa et al.
6,261,688 B1 7/2001 Kaplan et al.
6,262,137 B1 7/2001 Kozma et al.
6,262,207 B1 7/2001 Rao et al.
6,303,215 B1 10/2001 Sonobe et al.
6,316,512 B1 11/2001 Bambara et al.
6,332,943 B1 12/2001 Herrmann et al.
6,354,700 B1 3/2002 Roth
6,357,869 B1 3/2002 Rasmussen et al.
6,357,870 B1 3/2002 Beach et al.
6,358,660 B1 3/2002 Agler et al.
6,363,234 B2 3/2002 Landa et al.
6,364,451 B1 4/2002 Silverbrook
6,377,772 B1 4/2002 Chowdry et al.
6,383,278 B1 5/2002 Hirasa et al.
6,386,697 B1 5/2002 Yamamoto et al.
6,390,617 B1 5/2002 Iwao
6,396,528 B1 5/2002 Yanagawa
6,397,034 B1 5/2002 Tarnawskyj et al.
6,400,913 B1 6/2002 De et al.
6,402,317 B2 6/2002 Yanagawa et al.
6,409,331 B1 6/2002 Gelbart
6,432,501 B1 8/2002 Yang et al.
6,438,352 B1 8/2002 Landa et al.
6,454,378 B1 9/2002 Silverbrook et al.
6,471,803 B1 10/2002 Pelland et al.
6,530,321 B2 3/2003 Andrew et al.
6,530,657 B2 3/2003 Polierer
6,531,520 B1 3/2003 Bambara et al.
6,551,394 B2 4/2003 Hirasa et al.
6,551,716 B1 4/2003 Landa et al.
6,554,189 B1 4/2003 Good et al.
6,559,969 B1 5/2003 Lapstun
6,575,547 B2 6/2003 Sakuma
6,586,100 B1 7/2003 Pickering et al.
6,590,012 B2 7/2003 Miyabayashi
6,608,979 B1 8/2003 Landa et al.
6,623,817 B1 9/2003 Yang et al.
6,630,047 B2 10/2003 Jing et al.
6,639,527 B2 10/2003 Johnson
6,648,468 B2 11/2003 Shinkoda et al.
6,678,068 B1 1/2004 Richter et al.
6,682,189 B2 1/2004 May et al.
6,685,769 B1 2/2004 Karl et al.
6,704,535 B2 3/2004 Kobayashi et al.
6,709,096 B1 3/2004 Beach et al.
6,716,562 B2 4/2004 Uehara et al.
6,719,423 B2 4/2004 Chowdry et al.
6,720,367 B2 4/2004 Taniguchi et al.
6,755,519 B2 6/2004 Gelbart et al.
6,761,446 B2 7/2004 Chowdry et al.
6,770,331 B1 8/2004 Mielke et al.
6,789,887 B2 9/2004 Yang et al.
6,811,840 B1 11/2004 Cross
6,827,018 B1 12/2004 Hartmann et al.
6,881,458 B2 4/2005 Ludwig et al.
6,898,403 B2 5/2005 Baker et al.
6,912,952 B1 7/2005 Landa et al.
6,916,862 B2 7/2005 Ota et al.
6,917,437 B1 7/2005 Myers et al.
6,966,712 B2 11/2005 Trelewicz et al.
6,970,674 B2 11/2005 Sato et al.
6,974,022 B2 12/2005 Saeki

(56) References Cited

U.S. PATENT DOCUMENTS

| | | | |
|---|---|---|---|
| 6,982,799 | B2 | 1/2006 | Lapstun |
| 6,983,692 | B2 | 1/2006 | Beauchamp et al. |
| 7,025,453 | B2 | 4/2006 | Ylitalo et al. |
| 7,057,760 | B2 | 6/2006 | Lapstun et al. |
| 7,084,202 | B2 | 8/2006 | Pickering et al. |
| 7,128,412 | B2 | 10/2006 | King et al. |
| 7,129,858 | B2 | 10/2006 | Ferran et al. |
| 7,134,953 | B2 | 11/2006 | Reinke |
| 7,160,377 | B2 | 1/2007 | Zoch et al. |
| 7,204,584 | B2 | 4/2007 | Lean et al. |
| 7,213,900 | B2 | 5/2007 | Ebihara |
| 7,224,478 | B1 | 5/2007 | Lapstun et al. |
| 7,265,819 | B2 | 9/2007 | Raney |
| 7,271,213 | B2 | 9/2007 | Hoshida et al. |
| 7,296,882 | B2 | 11/2007 | Buehler et al. |
| 7,300,133 | B1 | 11/2007 | Folkins et al. |
| 7,300,147 | B2 | 11/2007 | Johnson |
| 7,304,753 | B1 | 12/2007 | Richter et al. |
| 7,322,689 | B2 | 1/2008 | Kohne et al. |
| 7,334,520 | B2 | 2/2008 | Geissler et al. |
| 7,348,368 | B2 | 3/2008 | Kakiuchi et al. |
| 7,360,887 | B2 | 4/2008 | Konno |
| 7,362,464 | B2 | 4/2008 | Kitazawa |
| 7,459,491 | B2 | 12/2008 | Tyvoll et al. |
| 7,527,359 | B2 | 5/2009 | Stevenson et al. |
| 7,575,314 | B2 | 8/2009 | Desie et al. |
| 7,612,125 | B2 | 11/2009 | Muller et al. |
| 7,655,707 | B2 | 2/2010 | Ma |
| 7,655,708 | B2 | 2/2010 | House et al. |
| 7,699,922 | B2 | 4/2010 | Breton et al. |
| 7,708,371 | B2 | 5/2010 | Yamanobe |
| 7,709,074 | B2 | 5/2010 | Uchida et al. |
| 7,712,890 | B2 | 5/2010 | Yahiro |
| 7,732,543 | B2 | 6/2010 | Loch et al. |
| 7,732,583 | B2 | 6/2010 | Annoura et al. |
| 7,808,670 | B2 | 10/2010 | Lapstun et al. |
| 7,810,922 | B2 | 10/2010 | Gervasi et al. |
| 7,845,788 | B2 | 12/2010 | Oku |
| 7,867,327 | B2 | 1/2011 | Sano et al. |
| 7,876,345 | B2 | 1/2011 | Houjou |
| 7,910,183 | B2 | 3/2011 | Wu |
| 7,919,544 | B2 | 4/2011 | Matsuyama et al. |
| 7,942,516 | B2 | 5/2011 | Ohara et al. |
| 7,977,408 | B2 | 7/2011 | Matsuyama et al. |
| 7,985,784 | B2 | 7/2011 | Kanaya et al. |
| 8,002,400 | B2 | 8/2011 | Kibayashi et al. |
| 8,012,538 | B2 | 9/2011 | Yokouchi |
| 8,025,389 | B2 | 9/2011 | Yamanobe et al. |
| 8,038,284 | B2 | 10/2011 | Hori et al. |
| 8,041,275 | B2 | 10/2011 | Soria et al. |
| 8,042,906 | B2 | 10/2011 | Chiwata et al. |
| 8,059,309 | B2 | 11/2011 | Lapstun et al. |
| 8,095,054 | B2 | 1/2012 | Nakamura |
| 8,109,595 | B2 | 2/2012 | Tanaka et al. |
| 8,122,846 | B2 | 2/2012 | Stiblert et al. |
| 8,147,055 | B2 | 4/2012 | Cellura et al. |
| 8,162,428 | B2 | 4/2012 | Eun et al. |
| 8,177,351 | B2 | 5/2012 | Taniuchi et al. |
| 8,186,820 | B2 | 5/2012 | Chiwata |
| 8,192,904 | B2 | 6/2012 | Nagai et al. |
| 8,215,762 | B2 | 7/2012 | Ageishi |
| 8,242,201 | B2 | 8/2012 | Goto et al. |
| 8,256,857 | B2 | 9/2012 | Folkins et al. |
| 8,263,683 | B2 | 9/2012 | Gibson et al. |
| 8,264,135 | B2 | 9/2012 | Ozolins et al. |
| 8,295,733 | B2 | 10/2012 | Imoto |
| 8,303,072 | B2 | 11/2012 | Shibata et al. |
| 8,304,043 | B2 | 11/2012 | Nagashima et al. |
| 8,353,589 | B2 | 1/2013 | Ikeda et al. |
| 8,434,847 | B2 | 5/2013 | Dejong et al. |
| 8,460,450 | B2 | 6/2013 | Taverizatshy et al. |
| 8,469,476 | B2 | 6/2013 | Mandel et al. |
| 8,474,963 | B2 | 7/2013 | Hasegawa et al. |
| 8,536,268 | B2 | 9/2013 | Karjala et al. |
| 8,546,466 | B2 | 10/2013 | Yamashita et al. |
| 8,556,400 | B2 | 10/2013 | Yatake et al. |
| 8,693,032 | B2 | 4/2014 | Goddard et al. |
| 8,711,304 | B2 | 4/2014 | Mathew et al. |
| 8,714,731 | B2 | 5/2014 | Leung et al. |
| 8,746,873 | B2 | 6/2014 | Tsukamoto et al. |
| 8,779,027 | B2 | 7/2014 | Idemura et al. |
| 8,802,221 | B2 | 8/2014 | Noguchi et al. |
| 8,867,097 | B2 | 10/2014 | Mizuno |
| 8,885,218 | B2 | 11/2014 | Hirose |
| 8,891,128 | B2 | 11/2014 | Yamazaki |
| 8,894,198 | B2 | 11/2014 | Hook et al. |
| 8,919,946 | B2 | 12/2014 | Suzuki et al. |
| 9,004,629 | B2 | 4/2015 | De et al. |
| 9,186,884 | B2 | 11/2015 | Landa et al. |
| 9,229,664 | B2 | 1/2016 | Landa et al. |
| 9,264,559 | B2 | 2/2016 | Motoyanagi et al. |
| 9,284,469 | B2 | 3/2016 | Song et al. |
| 9,290,016 | B2 | 3/2016 | Landa et al. |
| 9,327,496 | B2 | 5/2016 | Landa et al. |
| 9,353,273 | B2 | 5/2016 | Landa et al. |
| 9,381,736 | B2 | 7/2016 | Landa et al. |
| 9,446,586 | B2 | 9/2016 | Matos et al. |
| 9,498,946 | B2 | 11/2016 | Landa et al. |
| 9,505,208 | B2 | 11/2016 | Shmaiser et al. |
| 9,517,618 | B2 | 12/2016 | Landa et al. |
| 9,566,780 | B2 | 2/2017 | Landa et al. |
| 9,568,862 | B2 | 2/2017 | Shmaiser et al. |
| 9,643,400 | B2 | 5/2017 | Landa et al. |
| 9,643,403 | B2 | 5/2017 | Landa et al. |
| 9,776,391 | B2 | 10/2017 | Landa et al. |
| 9,782,993 | B2 | 10/2017 | Landa et al. |
| 9,849,667 | B2 | 12/2017 | Landa et al. |
| 9,884,479 | B2 | 2/2018 | Landa et al. |
| 9,902,147 | B2 | 2/2018 | Shmaiser et al. |
| 9,914,316 | B2 | 3/2018 | Landa et al. |
| 10,065,411 | B2 | 9/2018 | Landa et al. |
| 10,175,613 | B2 | 1/2019 | Watanabe |
| 10,179,447 | B2 | 1/2019 | Shmaiser et al. |
| 10,190,012 | B2 | 1/2019 | Landa et al. |
| 10,195,843 | B2 | 2/2019 | Landa et al. |
| 10,201,968 | B2 | 2/2019 | Landa et al. |
| 10,226,920 | B2 | 3/2019 | Shmaiser et al. |
| 10,266,711 | B2 | 4/2019 | Landa et al. |
| 10,300,690 | B2 | 5/2019 | Landa et al. |
| 10,357,963 | B2 | 7/2019 | Landa et al. |
| 10,357,985 | B2 | 7/2019 | Landa et al. |
| 10,427,399 | B2 | 10/2019 | Shmaiser et al. |
| 10,434,761 | B2 | 10/2019 | Landa et al. |
| 10,703,094 | B2 | 7/2020 | Shmaiser et al. |
| 2001/0022607 | A1 | 9/2001 | Takahashi et al. |
| 2002/0041317 | A1 | 4/2002 | Kashiwazaki et al. |
| 2002/0064404 | A1 | 5/2002 | Iwai |
| 2002/0102374 | A1 | 8/2002 | Gervasi et al. |
| 2002/0121220 | A1 | 9/2002 | Lin |
| 2002/0150408 | A1 | 10/2002 | Mosher et al. |
| 2002/0164494 | A1 | 11/2002 | Grant et al. |
| 2002/0197481 | A1 | 12/2002 | Jing et al. |
| 2003/0004025 | A1 | 1/2003 | Okuno et al. |
| 2003/0018119 | A1 | 1/2003 | Frenkel et al. |
| 2003/0030686 | A1 | 2/2003 | Abe et al. |
| 2003/0032700 | A1 | 2/2003 | Morrison et al. |
| 2003/0043258 | A1 | 3/2003 | Kerr et al. |
| 2003/0054139 | A1 | 3/2003 | Ylitalo et al. |
| 2003/0055129 | A1 | 3/2003 | Alford |
| 2003/0063179 | A1 | 4/2003 | Adachi |
| 2003/0064317 | A1 | 4/2003 | Bailey et al. |
| 2003/0081964 | A1 | 5/2003 | Shimura et al. |
| 2003/0118381 | A1 | 6/2003 | Law et al. |
| 2003/0129435 | A1 | 7/2003 | Blankenship et al. |
| 2003/0186147 | A1 | 10/2003 | Pickering et al. |
| 2003/0214568 | A1 | 11/2003 | Nishikawa et al. |
| 2003/0234849 | A1 | 12/2003 | Pan et al. |
| 2004/0003863 | A1 | 1/2004 | Eckhardt |
| 2004/0020382 | A1 | 2/2004 | McLean et al. |
| 2004/0036758 | A1 | 2/2004 | Sasaki et al. |
| 2004/0047666 | A1 | 3/2004 | Imaizumi et al. |
| 2004/0087707 | A1 | 5/2004 | Zoch et al. |
| 2004/0123761 | A1 | 7/2004 | Szumla et al. |
| 2004/0125188 | A1 | 7/2004 | Szumla et al. |

(56) References Cited

U.S. PATENT DOCUMENTS

2004/0145643 A1 7/2004 Nakamura
2004/0173111 A1 9/2004 Okuda
2004/0200369 A1 10/2004 Brady
2004/0228642 A1 11/2004 Iida et al.
2004/0246324 A1 12/2004 Nakashima
2004/0246326 A1 12/2004 Dwyer et al.
2004/0252175 A1 12/2004 Bejat et al.
2005/0031807 A1 2/2005 Quintens et al.
2005/0082146 A1 4/2005 Axmann
2005/0110855 A1 5/2005 Taniuchi et al.
2005/0111861 A1 5/2005 Calamita et al.
2005/0134874 A1 6/2005 Overall et al.
2005/0150408 A1 7/2005 Hesterman
2005/0195235 A1 9/2005 Kitao
2005/0235870 A1 10/2005 Ishihara
2005/0266332 A1 12/2005 Pavlisko et al.
2005/0272334 A1 12/2005 Wang et al.
2006/0004123 A1 1/2006 Wu et al.
2006/0135709 A1 6/2006 Hasegawa et al.
2006/0164488 A1 7/2006 Taniuchi et al.
2006/0164489 A1 7/2006 Vega et al.
2006/0192827 A1 8/2006 Takada et al.
2006/0233578 A1 10/2006 Maki et al.
2006/0286462 A1 12/2006 Jackson et al.
2007/0014595 A1 1/2007 Kawagoe
2007/0025768 A1 2/2007 Komatsu et al.
2007/0029171 A1 2/2007 Nemedi
2007/0045939 A1 3/2007 Toya et al.
2007/0054981 A1 3/2007 Yanagi et al.
2007/0064077 A1 3/2007 Konno
2007/0077520 A1 4/2007 Maemoto
2007/0120927 A1 5/2007 Snyder et al.
2007/0123642 A1 5/2007 Banning et al.
2007/0134030 A1 6/2007 Lior et al.
2007/0144368 A1 6/2007 Barazani et al.
2007/0146462 A1 6/2007 Taniuchi et al.
2007/0147894 A1 6/2007 Yokota et al.
2007/0166071 A1 7/2007 Shima
2007/0176995 A1 8/2007 Kadomatsu et al.
2007/0189819 A1 8/2007 Uehara et al.
2007/0199457 A1 8/2007 Cyman, Jr. et al.
2007/0229639 A1 10/2007 Yahiro
2007/0253726 A1 11/2007 Kagawa
2007/0257955 A1 11/2007 Tanaka et al.
2007/0285486 A1 12/2007 Harris et al.
2008/0006176 A1 1/2008 Houjou
2008/0030536 A1 2/2008 Furukawa et al.
2008/0032072 A1 2/2008 Taniuchi et al.
2008/0044587 A1 2/2008 Maeno et al.
2008/0055356 A1 3/2008 Yamanobe
2008/0055381 A1 3/2008 Doi et al.
2008/0074462 A1 3/2008 Hirakawa
2008/0112912 A1 5/2008 Springob et al.
2008/0124158 A1* 5/2008 Folkins ..... G03G 15/0163 399/396
2008/0138546 A1 6/2008 Soria et al.
2008/0166495 A1 7/2008 Maeno et al.
2008/0167185 A1 7/2008 Hirota
2008/0175612 A1 7/2008 Oikawa et al.
2008/0196612 A1 8/2008 Rancourt et al.
2008/0196621 A1 8/2008 Ikuno et al.
2008/0213548 A1 9/2008 Koganehira et al.
2008/0236480 A1 10/2008 Furukawa et al.
2008/0253812 A1 10/2008 Pearce et al.
2009/0022504 A1 1/2009 Kuwabara et al.
2009/0041515 A1 2/2009 Kim
2009/0041932 A1 2/2009 Ishizuka et al.
2009/0074492 A1 3/2009 Ito
2009/0082503 A1 3/2009 Yanagi et al.
2009/0087565 A1 4/2009 Houjou
2009/0098385 A1 4/2009 Kaemper et al.
2009/0116885 A1 5/2009 Ando
2009/0148200 A1 6/2009 Hara et al.
2009/0165937 A1 7/2009 Inoue et al.
2009/0190951 A1 7/2009 Torimaru et al.
2009/0202275 A1 8/2009 Nishida et al.
2009/0211490 A1 8/2009 Ikuno et al.
2009/0220873 A1 9/2009 Enomoto et al.
2009/0237479 A1 9/2009 Yamashita et al.
2009/0256896 A1 10/2009 Scarlata
2009/0279170 A1 11/2009 Miyazaki et al.
2009/0315926 A1 12/2009 Yamanobe
2009/0317555 A1 12/2009 Hori
2009/0318591 A1 12/2009 Ageishi et al.
2010/0012023 A1 1/2010 Lefevre et al.
2010/0053292 A1 3/2010 Thayer et al.
2010/0053293 A1 3/2010 Thayer et al.
2010/0066796 A1 3/2010 Yanagi et al.
2010/0075843 A1 3/2010 Ikuno et al.
2010/0086692 A1 4/2010 Ohta et al.
2010/0091064 A1 4/2010 Araki et al.
2010/0225695 A1 9/2010 Fujikura
2010/0231623 A1 9/2010 Hirato
2010/0239789 A1 9/2010 Umeda
2010/0245511 A1 9/2010 Ageishi
2010/0282100 A1 11/2010 Okuda et al.
2010/0285221 A1 11/2010 Oki et al.
2010/0303504 A1 12/2010 Funamoto et al.
2010/0310281 A1 12/2010 Miura et al.
2011/0044724 A1 2/2011 Funamoto et al.
2011/0058001 A1 3/2011 Gila et al.
2011/0058859 A1 3/2011 Nakamatsu et al.
2011/0085828 A1 4/2011 Kosako et al.
2011/0128300 A1 6/2011 Gay et al.
2011/0141188 A1 6/2011 Morita
2011/0149002 A1 6/2011 Kessler
2011/0150509 A1 6/2011 Komiya
2011/0150541 A1 6/2011 Michibata
2011/0169889 A1 7/2011 Kojima et al.
2011/0195260 A1 8/2011 Lee et al.
2011/0199414 A1 8/2011 Lang
2011/0234683 A1 9/2011 Komatsu
2011/0234689 A1 9/2011 Saito
2011/0249090 A1 10/2011 Moore et al.
2011/0269885 A1 11/2011 Imai
2011/0279554 A1 11/2011 Dannhauser et al.
2011/0304674 A1 12/2011 Sambhy et al.
2012/0013693 A1 1/2012 Tasaka et al.
2012/0013694 A1 1/2012 Kanke
2012/0013928 A1 1/2012 Yoshida et al.
2012/0026224 A1 2/2012 Anthony et al.
2012/0039647 A1 2/2012 Brewington et al.
2012/0094091 A1 4/2012 Van et al.
2012/0098882 A1 4/2012 Onishi et al.
2012/0105561 A1 5/2012 Taniuchi et al.
2012/0105562 A1 5/2012 Sekiguchi et al.
2012/0113180 A1 5/2012 Tanaka et al.
2012/0113203 A1 5/2012 Kushida et al.
2012/0127250 A1 5/2012 Kanasugi et al.
2012/0127251 A1 5/2012 Tsuji et al.
2012/0140009 A1 6/2012 Kanasugi et al.
2012/0156375 A1 6/2012 Brust et al.
2012/0156624 A1 6/2012 Rondon et al.
2012/0162302 A1 6/2012 Oguchi et al.
2012/0163846 A1 6/2012 Andoh et al.
2012/0194830 A1 8/2012 Gaertner et al.
2012/0237260 A1 9/2012 Sengoku et al.
2012/0287260 A1 11/2012 Lu et al.
2012/0301186 A1 11/2012 Yang et al.
2012/0314077 A1 12/2012 Clavenna, II et al.
2013/0017006 A1 1/2013 Suda
2013/0044188 A1 2/2013 Nakamura et al.
2013/0057603 A1 3/2013 Gordon
2013/0088543 A1 4/2013 Tsuji et al.
2013/0120513 A1 5/2013 Thayer et al.
2013/0201237 A1 8/2013 Thomson et al.
2013/0234080 A1 9/2013 Torikoshi et al.
2013/0242016 A1 9/2013 Edwards et al.
2013/0338273 A1 12/2013 Shimanaka et al.
2014/0001013 A1 1/2014 Takifuji et al.
2014/0011125 A1 1/2014 Inoue et al.
2014/0043398 A1 2/2014 Butler et al.
2014/0104360 A1 4/2014 Häcker et al.
2014/0168330 A1 6/2014 Liu et al.

(56) References Cited

U.S. PATENT DOCUMENTS

| | | | | |
|---|---|---|---|---|
| 2014/0175707 | A1 | 6/2014 | Wolk et al. | |
| 2014/0232782 | A1 | 8/2014 | Mukai et al. | |
| 2014/0267777 | A1 | 9/2014 | Le et al. | |
| 2014/0334855 | A1* | 11/2014 | Onishi | G03G 15/1615 399/301 |
| 2014/0339056 | A1 | 11/2014 | Iwakoshi et al. | |
| 2015/0024648 | A1 | 1/2015 | Landa et al. | |
| 2015/0025179 | A1 | 1/2015 | Landa et al. | |
| 2015/0042736 | A1* | 2/2015 | Landa | G03G 15/10 347/103 |
| 2015/0072090 | A1 | 3/2015 | Landa et al. | |
| 2015/0085036 | A1 | 3/2015 | Liu et al. | |
| 2015/0085037 | A1 | 3/2015 | Liu et al. | |
| 2015/0116408 | A1 | 4/2015 | Armbruster et al. | |
| 2015/0118503 | A1 | 4/2015 | Landa et al. | |
| 2015/0195509 | A1 | 7/2015 | Phipps | |
| 2015/0210065 | A1 | 7/2015 | Kelly et al. | |
| 2015/0304531 | A1 | 10/2015 | Rodriguez et al. | |
| 2015/0336378 | A1 | 11/2015 | Guttmann et al. | |
| 2015/0361288 | A1 | 12/2015 | Song et al. | |
| 2016/0031246 | A1 | 2/2016 | Sreekumar et al. | |
| 2016/0222232 | A1 | 8/2016 | Landa et al. | |
| 2016/0286462 | A1 | 9/2016 | Gohite et al. | |
| 2016/0375680 | A1 | 12/2016 | Nishitani et al. | |
| 2017/0028688 | A1 | 2/2017 | Dannhauser et al. | |
| 2017/0104887 | A1 | 4/2017 | Nomura | |
| 2017/0192374 | A1 | 7/2017 | Landa et al. | |
| 2017/0244956 | A1 | 8/2017 | Stiglic et al. | |
| 2018/0093470 | A1 | 4/2018 | Landa et al. | |
| 2018/0259888 | A1 | 9/2018 | Mitsui et al. | |
| 2019/0016114 | A1 | 1/2019 | Sugiyama et al. | |
| 2019/0023000 | A1 | 1/2019 | Landa et al. | |
| 2019/0023919 | A1 | 1/2019 | Landa et al. | |
| 2019/0094727 | A1 | 3/2019 | Landa et al. | |
| 2019/0118530 | A1 | 4/2019 | Landa et al. | |
| 2019/0152218 | A1 | 5/2019 | Stein et al. | |
| 2019/0168502 | A1 | 6/2019 | Shmaiser et al. | |
| 2019/0193391 | A1 | 6/2019 | Landa et al. | |
| 2019/0202198 | A1 | 7/2019 | Shmaiser et al. | |
| 2019/0218411 | A1 | 7/2019 | Landa et al. | |
| 2019/0256724 | A1 | 8/2019 | Landa et al. | |
| 2020/0156366 | A1 | 5/2020 | Shmaiser et al. | |
| 2020/0171813 | A1 | 6/2020 | Chechik et al. | |
| 2020/0189264 | A1 | 6/2020 | Landa et al. | |
| 2020/0198322 | A1 | 6/2020 | Landa et al. | |

FOREIGN PATENT DOCUMENTS

| | | | |
|---|---|---|---|
| CN | 1212229 | A | 3/1999 |
| CN | 1324901 | A | 12/2001 |
| CN | 1493514 | A | 5/2004 |
| CN | 1720187 | A | 1/2006 |
| CN | 1261831 | C | 6/2006 |
| CN | 1809460 | A | 7/2006 |
| CN | 1289368 | C | 12/2006 |
| CN | 101073937 | A | 11/2007 |
| CN | 101177057 | A | 5/2008 |
| CN | 101249768 | A | 8/2008 |
| CN | 101344746 | A | 1/2009 |
| CN | 101359210 | A | 2/2009 |
| CN | 101508200 | A | 8/2009 |
| CN | 101524916 | A | 9/2009 |
| CN | 101544100 | A | 9/2009 |
| CN | 101544101 | A | 9/2009 |
| CN | 101607468 | A | 12/2009 |
| CN | 201410787 | Y | 2/2010 |
| CN | 101835611 | A | 9/2010 |
| CN | 101873982 | A | 10/2010 |
| CN | 102248776 | A | 11/2011 |
| CN | 102555450 | A | 7/2012 |
| CN | 102648095 | A | 8/2012 |
| CN | 102925002 | A | 2/2013 |
| CN | 103045008 | A | 4/2013 |
| CN | 103309213 | A | 9/2013 |
| CN | 103991293 | A | 8/2014 |
| CN | 104271356 | A | 1/2015 |
| CN | 104284850 | A | 1/2015 |
| CN | 104618642 | A | 5/2015 |
| CN | 105058999 | A | 11/2015 |
| DE | 102010060999 | A1 | 6/2012 |
| EP | 0457551 | A2 | 11/1991 |
| EP | 0499857 | A1 | 8/1992 |
| EP | 0606490 | A1 | 7/1994 |
| EP | 0609076 | A2 | 8/1994 |
| EP | 0613791 | A2 | 9/1994 |
| EP | 0530627 | B1 | 3/1997 |
| EP | 0784244 | A2 | 7/1997 |
| EP | 0835762 | A1 | 4/1998 |
| EP | 0843236 | A2 | 5/1998 |
| EP | 0854398 | A2 | 7/1998 |
| EP | 1013466 | A2 | 6/2000 |
| EP | 1146090 | A2 | 10/2001 |
| EP | 1158029 | A1 | 11/2001 |
| EP | 0825029 | B1 | 5/2002 |
| EP | 1247821 | A2 | 10/2002 |
| EP | 0867483 | B1 | 6/2003 |
| EP | 0923007 | B1 | 3/2004 |
| EP | 1454968 | A1 | 9/2004 |
| EP | 1503326 | A1 | 2/2005 |
| EP | 1777243 | A1 | 4/2007 |
| EP | 2028238 | A1 | 2/2009 |
| EP | 2042317 | A1 | 4/2009 |
| EP | 2065194 | A2 | 6/2009 |
| EP | 2228210 | A1 | 9/2010 |
| EP | 2270070 | A1 | 1/2011 |
| EP | 2042318 | B1 | 2/2011 |
| EP | 2042325 | B1 | 2/2012 |
| EP | 2634010 | A1 | 9/2013 |
| EP | 2683556 | A1 | 1/2014 |
| EP | 2075635 | B1 | 10/2014 |
| GB | 748821 | A | 5/1956 |
| GB | 1496016 | A | 12/1977 |
| GB | 1520932 | A | 8/1978 |
| GB | 1522175 | A | 8/1978 |
| GB | 2321430 | A | 7/1998 |
| JP | S5578904 | A | 6/1980 |
| JP | S57121446 | U | 7/1982 |
| JP | S6076343 | A | 4/1985 |
| JP | S60199692 | A | 10/1985 |
| JP | S6223783 | A | 1/1987 |
| JP | H03248170 | A | 11/1991 |
| JP | H05147208 | A | 6/1993 |
| JP | H05192871 | A | 8/1993 |
| JP | H05297737 | A | 11/1993 |
| JP | H06954 | A | 1/1994 |
| JP | H06100807 | A | 4/1994 |
| JP | H06171076 | A | 6/1994 |
| JP | H06345284 | A | 12/1994 |
| JP | H07112841 | A | 5/1995 |
| JP | H07186453 | A | 7/1995 |
| JP | H07238243 | A | 9/1995 |
| JP | H0862999 | A | 3/1996 |
| JP | H08112970 | A | 5/1996 |
| JP | 2529651 | B2 | 8/1996 |
| JP | H09123432 | A | 5/1997 |
| JP | H09157559 | A | 6/1997 |
| JP | H09281851 | A | 10/1997 |
| JP | H09314867 | A | 12/1997 |
| JP | H1142811 | A | 2/1999 |
| JP | H11503244 | A | 3/1999 |
| JP | H11106081 | A | 4/1999 |
| JP | H11245383 | A | 9/1999 |
| JP | 2000108320 | A | 4/2000 |
| JP | 2000108334 | A | 4/2000 |
| JP | 2000141710 | A | 5/2000 |
| JP | 2000168062 | A | 6/2000 |
| JP | 2000169772 | A | 6/2000 |
| JP | 2000206801 | A | 7/2000 |
| JP | 2001088430 | A | 4/2001 |
| JP | 2001098201 | A | 4/2001 |
| JP | 2001139865 | A | 5/2001 |
| JP | 3177985 | B2 | 6/2001 |
| JP | 2001164165 | A | 6/2001 |

(56) References Cited

FOREIGN PATENT DOCUMENTS

| | | | | |
|---|---|---|---|---|
| JP | 2001199150 | A | | 7/2001 |
| JP | 2001206522 | A | | 7/2001 |
| JP | 2002020666 | A | | 1/2002 |
| JP | 2002049211 | A | * | 2/2002 |
| JP | 2002069346 | A | | 3/2002 |
| JP | 2002103598 | A | | 4/2002 |
| JP | 2002169383 | A | | 6/2002 |
| JP | 2002229276 | A | | 8/2002 |
| JP | 2002234243 | A | | 8/2002 |
| JP | 2002278365 | A | | 9/2002 |
| JP | 2002304066 | A | | 10/2002 |
| JP | 2002326733 | A | | 11/2002 |
| JP | 2002371208 | A | | 12/2002 |
| JP | 2003057967 | A | | 2/2003 |
| JP | 2003114558 | A | | 4/2003 |
| JP | 2003145914 | A | | 5/2003 |
| JP | 2003183557 | A | | 7/2003 |
| JP | 2003211770 | A | | 7/2003 |
| JP | 2003219271 | A | | 7/2003 |
| JP | 2003246135 | A | | 9/2003 |
| JP | 2003246484 | A | | 9/2003 |
| JP | 2003292855 | A | | 10/2003 |
| JP | 2003313466 | A | | 11/2003 |
| JP | 2004009632 | A | | 1/2004 |
| JP | 2004019022 | A | | 1/2004 |
| JP | 2004025708 | A | | 1/2004 |
| JP | 2004034441 | A | | 2/2004 |
| JP | 2004077669 | A | | 3/2004 |
| JP | 2004114377 | A | | 4/2004 |
| JP | 2004114675 | A | | 4/2004 |
| JP | 2004148687 | A | | 5/2004 |
| JP | 2004231711 | A | | 8/2004 |
| JP | 2004524190 | A | | 8/2004 |
| JP | 2004261975 | A | | 9/2004 |
| JP | 2004325782 | A | | 11/2004 |
| JP | 2005014255 | A | | 1/2005 |
| JP | 2005014256 | A | | 1/2005 |
| JP | 2005114769 | A | | 4/2005 |
| JP | 2005215247 | A | | 8/2005 |
| JP | 2005307184 | A | | 11/2005 |
| JP | 2005319593 | A | | 11/2005 |
| JP | 2006001688 | A | | 1/2006 |
| JP | 2006023403 | A | | 1/2006 |
| JP | 2006095870 | A | | 4/2006 |
| JP | 2006102975 | A | | 4/2006 |
| JP | 2006137127 | A | | 6/2006 |
| JP | 2006143778 | A | | 6/2006 |
| JP | 2006152133 | A | | 6/2006 |
| JP | 2006224583 | A | | 8/2006 |
| JP | 2006231666 | A | | 9/2006 |
| JP | 2006234212 | A | | 9/2006 |
| JP | 2006243212 | A | | 9/2006 |
| JP | 2006263984 | A | | 10/2006 |
| JP | 2006347081 | A | | 12/2006 |
| JP | 2006347085 | A | | 12/2006 |
| JP | 2007025246 | A | | 2/2007 |
| JP | 2007041530 | A | | 2/2007 |
| JP | 2007069584 | A | | 3/2007 |
| JP | 2007079159 | A | * | 3/2007 |
| JP | 2007083445 | A | | 4/2007 |
| JP | 2007190745 | A | | 8/2007 |
| JP | 2007216673 | A | | 8/2007 |
| JP | 2007253347 | A | | 10/2007 |
| JP | 2007334125 | A | | 12/2007 |
| JP | 2008006816 | A | | 1/2008 |
| JP | 2008018716 | A | | 1/2008 |
| JP | 2008019286 | A | | 1/2008 |
| JP | 2008036968 | A | | 2/2008 |
| JP | 2008137239 | A | | 6/2008 |
| JP | 2008139877 | A | | 6/2008 |
| JP | 2008142962 | A | | 6/2008 |
| JP | 2008183744 | A | | 8/2008 |
| JP | 2008194997 | A | | 8/2008 |
| JP | 2008532794 | A | | 8/2008 |
| JP | 2008201564 | A | | 9/2008 |
| JP | 2008238674 | A | | 10/2008 |
| JP | 2008246990 | A | | 10/2008 |
| JP | 2008254203 | A | | 10/2008 |
| JP | 2008255135 | A | | 10/2008 |
| JP | 2009040892 | A | | 2/2009 |
| JP | 2009045794 | A | | 3/2009 |
| JP | 2009045851 | A | | 3/2009 |
| JP | 2009045885 | A | | 3/2009 |
| JP | 2009083314 | A | | 4/2009 |
| JP | 2009083317 | A | | 4/2009 |
| JP | 2009083325 | A | | 4/2009 |
| JP | 2009096175 | A | | 5/2009 |
| JP | 2009148908 | A | | 7/2009 |
| JP | 2009154330 | A | | 7/2009 |
| JP | 2009190375 | A | | 8/2009 |
| JP | 2009202355 | A | | 9/2009 |
| JP | 2009214318 | A | | 9/2009 |
| JP | 2009214439 | A | | 9/2009 |
| JP | 2009226852 | A | | 10/2009 |
| JP | 2009226886 | A | | 10/2009 |
| JP | 2009233977 | A | | 10/2009 |
| JP | 2009234219 | A | | 10/2009 |
| JP | 2010005815 | A | | 1/2010 |
| JP | 2010054855 | A | | 3/2010 |
| JP | 2010510357 | A | | 4/2010 |
| JP | 2010105365 | A | | 5/2010 |
| JP | 2010173201 | A | | 8/2010 |
| JP | 2010184376 | A | | 8/2010 |
| JP | 2010214885 | A | | 9/2010 |
| JP | 2010228192 | A | | 10/2010 |
| JP | 2010228392 | A | | 10/2010 |
| JP | 2010234599 | A | | 10/2010 |
| JP | 2010234681 | A | | 10/2010 |
| JP | 2010241073 | A | | 10/2010 |
| JP | 2010247381 | A | | 11/2010 |
| JP | 2010247528 | A | | 11/2010 |
| JP | 2010258193 | A | | 11/2010 |
| JP | 2010260204 | A | | 11/2010 |
| JP | 2010260287 | A | | 11/2010 |
| JP | 2010260302 | A | | 11/2010 |
| JP | 2010286570 | A | | 12/2010 |
| JP | 2011002532 | A | | 1/2011 |
| JP | 2011025431 | A | | 2/2011 |
| JP | 2011037070 | A | | 2/2011 |
| JP | 2011067956 | A | | 4/2011 |
| JP | 2011126031 | A | | 6/2011 |
| JP | 2011133884 | A | | 7/2011 |
| JP | 2011144271 | A | | 7/2011 |
| JP | 2011523601 | A | | 8/2011 |
| JP | 2011173325 | A | | 9/2011 |
| JP | 2011173326 | A | | 9/2011 |
| JP | 2011186346 | A | | 9/2011 |
| JP | 2011189627 | A | | 9/2011 |
| JP | 2011201951 | A | | 10/2011 |
| JP | 2011224032 | A | | 11/2011 |
| JP | 2012042943 | A | | 3/2012 |
| JP | 2012086499 | A | | 5/2012 |
| JP | 2012111194 | A | | 6/2012 |
| JP | 2012126123 | A | | 7/2012 |
| JP | 2012139905 | A | | 7/2012 |
| JP | 2012196787 | A | | 10/2012 |
| JP | 2012201419 | A | | 10/2012 |
| JP | 2013001081 | A | | 1/2013 |
| JP | 2013060299 | A | | 4/2013 |
| JP | 2013103474 | A | | 5/2013 |
| JP | 2013121671 | A | | 6/2013 |
| JP | 2013129158 | A | | 7/2013 |
| JP | 2014047005 | A | | 3/2014 |
| JP | 2014094827 | A | | 5/2014 |
| JP | 2016185688 | A | | 10/2016 |
| RU | 2180675 | C2 | | 3/2002 |
| RU | 2282643 | C1 | | 8/2006 |
| WO | WO-8600327 | A1 | | 1/1986 |
| WO | WO-9307000 | A1 | | 4/1993 |
| WO | WO-9604339 | A1 | | 2/1996 |
| WO | WO-9631809 | A1 | | 10/1996 |
| WO | WO-9707991 | A1 | | 3/1997 |
| WO | WO-9736210 | A1 | | 10/1997 |
| WO | WO-9821251 | A1 | | 5/1998 |

(56) References Cited

FOREIGN PATENT DOCUMENTS

| | | | |
|---|---|---|---|
| WO | WO-9855901 | A1 | 12/1998 |
| WO | WO-9912633 | A1 | 3/1999 |
| WO | WO-9942509 | A1 | 8/1999 |
| WO | WO-9943502 | A2 | 9/1999 |
| WO | WO-0064685 | A1 | 11/2000 |
| WO | WO-0154902 | A1 | 8/2001 |
| WO | WO-0170512 | A1 | 9/2001 |
| WO | WO-02068191 | A1 | 9/2002 |
| WO | WO-02078868 | A2 | 10/2002 |
| WO | WO-02094912 | A1 | 11/2002 |
| WO | WO-2004113082 | A1 | 12/2004 |
| WO | WO-2004113450 | A1 | 12/2004 |
| WO | WO-2006051733 | A1 | 5/2006 |
| WO | WO-2006069205 | A1 | 6/2006 |
| WO | WO-2006073696 | A1 | 7/2006 |
| WO | WO-2006091957 | A2 | 8/2006 |
| WO | WO-2007009871 | A2 | 1/2007 |
| WO | WO-2007145378 | A1 | 12/2007 |
| WO | WO-2008078841 | A1 | 7/2008 |
| WO | WO-2009025809 | A1 | 2/2009 |
| WO | WO-2009134273 | A1 | 11/2009 |
| WO | WO-2010042784 | A3 | 7/2010 |
| WO | WO-2010073916 | A1 | 7/2010 |
| WO | WO-2011142404 | A1 | 11/2011 |
| WO | WO-2012014825 | A1 | 2/2012 |
| WO | WO-2012148421 | A1 | 11/2012 |
| WO | WO-2013060377 | A1 | 5/2013 |
| WO | WO-2013087249 | A1 | 6/2013 |
| WO | WO-2013132339 | A1 | 9/2013 |
| WO | WO-2013132340 | A1 | 9/2013 |
| WO | WO-2013132343 | A1 | 9/2013 |
| WO | WO-2013132345 | A1 | 9/2013 |
| WO | WO-2013132356 | A1 | 9/2013 |
| WO | WO-2013132418 | A2 | 9/2013 |
| WO | WO-2013132419 | A1 | 9/2013 |
| WO | WO-2013132420 | A1 | 9/2013 |
| WO | WO-2013132424 | A1 | 9/2013 |
| WO | WO-2013132432 | A1 | 9/2013 |
| WO | WO-2013132438 | A2 | 9/2013 |
| WO | WO-2013132439 | A1 | 9/2013 |
| WO | WO-2013136220 | A1 | 9/2013 |
| WO | WO-2015036864 | A1 | 3/2015 |
| WO | WO-2015036906 | A1 | 3/2015 |
| WO | WO-2015036960 | A1 | 3/2015 |
| WO | WO-2016166690 | A1 | 10/2016 |
| WO | WO-2017208246 | A1 | 12/2017 |

OTHER PUBLICATIONS

CN101249768A Machine Translation (by EPO and Google)—published Aug. 27, 2008; Shantou Xinxie Special Paper T [CN].
CN101344746A Machine Translation (by EPO and Google)—published Jan. 14, 2009; Ricoh KK [JP].
CN101359210A Machine Translation (by EPO and Google)—published Feb. 4, 2009; Canon KK [JP].
CN101524916A Machine Translation (by EPO and Google)—published Sep. 9, 2009; Fuji Xerox Co Ltd.
CN101544100A Machine Translation (by EPO and Google)—published Sep. 30, 2009; Fuji Xerox Co Ltd.
CN102648095A Machine Translation (by EPO and Google)—published Aug. 22, 2012; Mars Inc.
CN103045008A Machine Translation (by EPO and Google)—published Apr. 17, 2013; Fuji Xerox Co Ltd.
CN105058999A Machine Translation (by EPO and Google)—published Nov. 18, 2015; Zhuoli Imaging Technology Co Ltd.
CN1121033A Machine Translation (by EPO and Google)—published Apr. 24, 1996; Kuehnle Manfred R [US].
CN1212229A Machine Translation (by EPO and Google)—published Mar. 31, 1999; Honta Industry Corp [JP].
CN201410787Y Machine Translation (by EPO and Google)—published Feb. 24, 2010; Zhejiang Chanx Wood Co Ltd.
Co-pending U.S. Appl. No. 16/590,397, filed Oct. 2, 2019.
Co-pending U.S. Appl. No. 16/649,177, filed Mar. 20, 2020.
Co-pending U.S. Appl. No. 16/764,330, filed May 14, 2020.
Co-pending U.S. Appl. No. 16/765,878, filed May 21, 2020.
Co-pending U.S. Appl. No. 16/784,208, filed Feb. 6, 2020.
Co-pending U.S. Appl. No. 16/793,995, filed Feb. 18, 2020.
Co-pending U.S. Appl. No. 16/814,900, filed Mar. 11, 2020.
Co-pending U.S. Appl. No. 16/850,229, filed Apr. 16, 2020.
Co-pending U.S. Appl. No. 16/883,617, filed May 26, 2020.
JP2000141710A Machine Translation (by EPO and Google)—published May 23, 2000; Brother Ind Ltd.
JP2000168062A Machine Translation (by EPO and Google)—published Jun. 20, 2000; Brother Ind Ltd.
JP2001088430A Machine Translation (by EPO and Google)—published Apr. 3, 2001; Kimoto KK.
JP2001098201A Machine Translation (by EPO and Google)—published Apr. 10, 2001; Eastman Kodak Co.
JP2001139865A Machine Translation (by EPO and Google)—published May 22, 2001; Sharp KK.
JP2001164165A Machine Translation (by EPO and Google)—published Jun. 19, 2001; Dainippon Ink & Chemicals.
JP2001199150A Machine Translation (by EPO and Google)—published Jul. 24, 2001; Canon KK.
JP2002069346A Machine Translation (by EPO and Google)—published Mar. 8, 2002; Dainippon Ink & Chemicals.
JP2002103598A Machine Translation (by EPO and Google)—published Apr. 9, 2002; Olympus Optical Co.
JP2003145914A Machine Translation (by EPO and Google)—published May 21, 2003; Konishiroku Photo Ind.
JP2003313466A Machine Translation (by EPO and Google)—published Nov. 6, 2003; Ricoh KK.
JP2006023403A Machine Translation (by EPO and Google)—published Jan. 26, 2006; Ricoh KK.
JP2006224583A Machine Translation (by EPO and Google)—published Aug. 31, 2006; Konica Minolta Holdings Inc.
JP2006231666A Machine Translation (by EPO and Google)—published Sep. 7, 2006; Seiko Epson Corp.
JP2006234212A Machine Translation (by EPO and Google)—published Sep. 7, 2006; Matsushita Electric Ind Co Ltd.
JP2007025246A Machine Translation (by EPO and Google)—published Feb. 1, 2007; Seiko Epson Corp.
JP2007083445A Machine Translation (by EPO and Google)—published Apr. 5, 2007; Fujifilm Corp.
JP2008139877A Machine Translation (by EPO and Google)—published Jun. 19, 2008; Xerox Corp.
JP2008183744A Machine Translation (by EPO and Google)—published Aug. 14, 2008, Fuji Xerox Co Ltd.
JP2008194997A Machine Translation (by EPO and Google)—published Aug. 28, 2008; Fuji Xerox Co Ltd.
JP2008238674A Machine Translation (by EPO and Google)—published Oct. 9, 2008; Brother Ind Ltd.
JP2008254203A Machine Translation (by EPO and Google)—published Oct. 23, 2008; Fujifilm Corp.
JP2010228392A Machine Translation (by EPO and Google)—published Oct. 14, 2010; Jujo Paper Co Ltd.
JP2010234599A Machine Translation (by EPO and Google)—published Oct. 21, 2010; Duplo Seiko Corp et al.
JP2011037070A Machine Translation (by EPO and Google)—published Feb. 24, 2011; Riso Kagaku Corp.
JP2011067956A Machine Translation (by EPO and Google)—published Apr. 7, 2011; Fuji Xerox Co Ltd.
JP2012196787A Machine Translation (by EPO and Google)—published Oct. 18, 2012; Seiko Epson Corp.
JP2012201419A Machine Translation (by EPO and Google)—published Oct. 22, 2012, Seiko Epson Corp.
JP2014047005A Machine Translation (by EPO and Google)—published Mar. 17, 2014; Ricoh Co Ltd.
JP2014094827A Machine Translation (by EPO and Google)—published May 22, 2014; Panasonic Corp.
JP2016185688A Machine Translation (by EPO and Google)—published Oct. 27, 2016; Hitachi Industry Equipment Systems Co Ltd.
JPH03248170A Machine Translation (by EPO and Google)—published Nov. 6, 1991; Fujitsu Ltd.

(56) References Cited

OTHER PUBLICATIONS

JPH06954A Machine Translation (by EPO and Google)—published Jan. 11, 1994; Seiko Epson Corp.
JPH09157559A Machine Translation (by EPO and Google)—published Jun. 17, 1997; Toyo Ink Mfg Co.
JPH11245383A Machine Translation (by EPO and Google)—published Sep. 14, 1999; Xerox Corp.
JPS6223783A Machine Translation (by EPO and Google)—published Jan. 31, 1987; Canon KK.
Larostat 264 A Quaternary Ammonium Compound, Technical Bulletin, BASF Corporation, Dec. 2002, p. 1.
Flexicon., "Bulk Handling Equipment and Systems: Carbon Black," 2018, 2 pages.
JP2004524190A Machine Translation (by EPO and Google)—published Aug. 12, 2004; Avery Dennison Corp.
JP2010234681A Machine Translation (by EPO and Google)—published Oct. 21, 2010; Riso Kagaku Corp.
JP2010260302A Machine Translation (by EPO and Google)—published Nov. 18, 2010; Riso Kagaku Corp.
JPH06171076A Machine Translation (by PlatPat English machine translation)—published Jun. 21, 1994, Seiko Epson Corp.
JPS60199692A Machine Translation (by EPO and Google)—published Oct. 9, 1985; Suwa Seikosha KK.
Montuori G.M., et al., "Geometrical Patterns for Diagrid Buildings: Exploring Alternative Design Strategies From the Structural Point of View," Engineering Structures, Jul. 2014, vol. 71, pp. 112-127.
Technical Information Lupasol Types, Sep. 2010, 10 pages.
The Engineering Toolbox., "Dynamic Viscosity of Common Liquids," 2018, 4 pages.
WO2006051733A1 Machine Translation (by EPO and Google)—published May 18, 2006; Konica Minolta Med & Graphic.
WO2010073916A1 Machine Translation (by EPO and Google)—published Jul. 1, 2010; Nihon Parkerizing [JP] et al.
"Amino Functional Silicone Polymers", in Xiameter.COPYRGT. 2009 Dow Corning Corporation.
"Solubility of Alcohol", in http://www.solubilityoflhings.com/water/alcohol; downloaded on Nov. 30, 2017.
BASF , "Joncryl 537", Datasheet , Retrieved from the internet : Mar. 23, 2007 p. 1.
Clariant., "Ultrafine Pigment Dispersion for Design and Creative Materials: Hostafine Pigment Preparation" Jun. 19, 2008. Retrieved from the Internet: [URL: http://www.clariant.com/C125720D002B963C/4352D0BC052E90CEC1257479002707D9/$FILE/DP6208E_0608_FL_Hostafinefordesignandcreativematerials.pdf].
CN101177057 Machine Translation (by EPO and Google)—published May 14, 2008—Hangzhou Yuanyang Industry Co.
CN101873982A Machine Translation (by EPO and Google)—published Oct. 27, 2010; Habasit AG, Delair et al.
CN102555450A Machine Translation (by EPO and Google)—published Jul. 11, 2012; Fuji Xerox Co., Ltd, Motoharu et al.
CN102925002 Machine Translation (by EPO and Google)—published Feb. 13, 2013; Jiangnan University, Fu et al.
CN103991293A Machine Translation (by EPO and Google)—published Aug. 20, 2014; Miyakoshi Printing Machinery Co., Ltd, Junichi et al.
CN104618642 Machine Translation (by EPO and Google); published on May 13, 2015, Yulong Comp Comm Tech Shenzhen.
CN1493514A Machine Translation (by EPO and Google)—published May 5, 2004; GD Spa, Boderi et al.
CN1809460A Machine Translation (by EPO and Google)—published Jul. 26, 2006; Canon KK.
Co-pending U.S. Appl. No. 16/303,613, filed Nov. 20, 2018.
Co-pending U.S. Appl. No. 16/303,615, filed Nov. 20, 2018.
Co-pending U.S. Appl. No. 16/303,631, filed Nov. 20, 2018.
Co-pending U.S. Appl. No. 16/432,934, filed Jun. 6, 2019.
Co-pending U.S. Appl. No. 16/433,970, filed Jun. 6, 2019.
Co-pending U.S. Appl. No. 16/542,362, filed Aug. 16, 2019.
DE102010060999 Machine Translation (by EPO and Google)—published Jun. 6, 2012; Wolf, Roland, Dr.-Ing.
Epomin Polyment, product information from Nippon Shokubai, dated Feb. 28, 2014.
Handbook of Print Media, 2001, Springer Verlag, Berlin/Heidelberg/New York, pp. 127-136,748—With English Translation.
IP.com Search, 2018, 2 pages.
IP.com Search, 2019, 1 page.
JP2000108320 Machine Translation (by PlatPat English machine translation)—published Apr. 18, 2000 Brother Ind. Ltd.
JP2000108334A Machine Translation (by EPO and Google)—published Apr. 18, 2000; Brother Ind Ltd.
JP2000169772 Machine Translation (by EPO and Google)—published Jun. 20, 2000; Tokyo Ink Mfg Co Ltd.
JP2000206801 Machine Translation (by PlatPat English machine translation); published on Jul. 28, 2000, Canon KK, Kobayashi et al.
JP2001206522 Machine Translation (by EPO, PlatPat and Google)—published Jul. 31, 2001; Nitto Denko Corp, Kato et al.
JP2002169383 Machine Translation (by EPO, PlatPat and Google)—published Jun. 14, 2002 Richo KK.
JP2002234243 Machine Translation (by EPO and Google)—published Aug. 20, 2002; Hitachi Koki Co Ltd.
JP2002278365 Machine Translation (by PlatPat English machine translation)—published Sep. 27, 2002 Katsuaki, Ricoh KK.
JP2002304066A Machine Translation (by EPO and Google)—published Oct. 18, 2002; PFU Ltd.
JP2002326733 Machine Translation (by EPO, PlatPat and Google)—published Nov. 12, 2002; Kyocera Mita Corp.
JP2002371208 Machine Translation (by EPO and Google)—published Dec. 26, 2002; Canon Inc.
JP2003114558 Machine Translation (by EPO, PlatPat and Google)—published Apr. 18, 2003 Mitsubishi Chem Corp, Yuka Denshi Co Ltd, et al.
JP2003211770 Machine Translation (by EPO and Google)—published Jul. 29, 2003 Hitachi Printing Solutions.
JP2003219271 Machine Translation (by EPO and Google); published on Jul. 31, 2003, Japan Broadcasting.
JP2003246135 Machine Translation (by PlatPat English machine translation)—published Sep. 2, 2003 Ricoh KK, Morohoshi et al.
JP2003246484 Machine Translation (English machine translation)—published Sep. 2, 2003 Kyocera Corp.
JP2003292855A Machine Translation (by EPO and Google)—published Oct. 15, 2003; Konishiroku Photo Ind.
JP2004009632A Machine Translation (by EPO and Google)—published Jan. 15, 2004; Konica Minolta Holdings Inc.
JP2004019022 Machine Translation (by EPO and Google)—published Jan. 22, 2004; Yamano et al.
JP2004025708A Machine Translation (by EPO and Google)—published Jan. 29, 2004; Konica Minolta Holdings Inc.
JP2004034441A Machine Translation (by EPO and Google)—published Feb. 5, 2004; Konica Minolta Holdings Inc.
JP2004077669 Machine Translation (by PlatPat English machine translation)—published Mar. 11, 2004 Fuji Xerox Co Ltd.
JP2004114377(A) Machine Translation (by EPO and Google)—published Apr. 15, 2004; Konica Minolta Holdings Inc, et al.
JP2004114675 Machine Translation (by EPO and Google)—published Apr. 15, 2004; Canon Inc.
JP2004148687A Machine Translation (by EPO and Google)—published May 27, 2014; Mitsubishi Heavy Ind Ltd.
JP2004231711 Machine Translation (by EPO and Google)—published Aug. 19, 2004; Seiko Epson Corp.
JP2004261975 Machine Translation (by EPO, PlatPat and Google); published on Sep. 24, 2004, Seiko Epson Corp, Kataoka et al.
JP2004325782A Machine Translation (by EPO and Google)—published Nov. 18, 2004; Canon KK.
JP2005014255 Machine Translation (by EPO and Google)—published Jan. 20, 2005; Canon Inc.
JP2005014256 Machine Translation (by EPO and Google)—published Jan. 20, 2005; Canon Inc.
JP2005114769 Machine Translation (by PlatPat English machine translation)—published Apr. 28, 2005 Ricoh KK.
JP2005215247A Machine Translation (by EPO and Google)—published Aug. 11, 2005; Toshiba Corp.
JP2005319593 Machine Translation (by EPO and Google)—published Nov. 17, 2005, Jujo Paper Co Ltd.

(56) References Cited

OTHER PUBLICATIONS

JP2006001688 Machine Translation (by PlatPat English machine translation)—published Jan. 5, 2006 Ricoh KK.
JP2006095870A Machine Translation (by EPO and Google)—published Apr. 13, 2006; Fuji Photo Film Co Ltd.
JP2006102975 Machine Translation (by EPO and Google)—published Apr. 20, 2006; Fuji Photo Film Co Ltd.
JP2006137127 Machine Translation (by EPO and Google)—published Jun. 1, 2006; Konica Minolta Med & Graphic.
JP2006143778 Machine Translation (by EPO, PlatPat and Google)—published Jun. 8, 2006 Sun Bijutsu Insatsu KK et al.
JP2006152133 Machine Translation (by EPO, PlatPat and Google)—published Jun. 15, 2006 Seiko Epson Corp.
JP2006243212 Machine Translation (by PlatPat English machine translation)—published Sep. 14, 2006 Fuji Xerox Co Ltd.
JP2006263984 Machine Translation (by EPO, PlatPat and Google)—published Oct. 5, 2006 Fuji Photo Film Co Ltd.
JP2006347081 Machine Translation (by EPO and Google)—published Dec. 28, 2006; Fuji Xerox Co Ltd.
JP2006347085 Machine Translation (by EPO and Google)—published Dec. 28, 2006 Fuji Xerox Co Ltd.
JP2007041530A Machine Translation (by EPO and Google)—published Feb. 15, 2007; Fuji Xerox Co Ltd.
JP2007069584 Machine Translation (by EPO and Google)—published Mar. 22, 2007 Fujifilm.
JP2007216673 Machine Translation (by EPO and Google)—published Aug. 30, 2007 Brother Ind.
JP2007253347A Machine Translation (by EPO and Google)—published Oct. 4, 2007; Ricoh KK, Matsuo et al.
JP2008006816 Machine Translation (by EPO and Google)—published Jan. 17, 2008; Fujifilm Corp.
JP2008018716 Machine Translation (by EPO and Google)—published Jan. 31, 2008; Canon Inc.
JP2008137239A Machine Translation (by EPO and Google); published on Jun. 19, 2008, Kyocera Mita Corp.
JP2008142962 Machine Translation (by EPO and Google)—published Jun. 26, 2008; Fuji Xerox Co Ltd.
JP2008201564 Machine Translation (English machine translation)—published Sep. 4, 2008 Fuji Xerox Co Ltd.
JP2008246990 Machine Translation (by EPO and Google)—published Oct. 16, 2008, Jujo Paper Co Ltd.
JP2008255135 Machine Translation (by EPO and Google)—published Oct. 23, 2008; Fujifilm Corp.
JP2009045794 Machine Translation (by EPO and Google)—published Mar. 5, 2009; Fujifilm Corp.
JP2009045851A Machine Translation (by EPO and Google); published on Mar. 5, 2009, Fujifilm Corp.
JP2009045885A Machine Translation (by EPO and Google)—published Mar. 5, 2009; Fuji Xerox Co Ltd.
JP2009083314 Machine Translation (by EPO, PlatPat and Google)—published Apr. 23, 2009 Fujifilm Corp.
JP2009083317 Abstract; Machine Translation (by EPO and Google)—published Apr. 23, 2009; Fuji Film Corp.
JP2009083325 Abstract; Machine Translation (by EPO and Google)—published Apr. 23, 2009 Fujifilm.
JP2009096175 Machine Translation (EPO, PlatPat and Google) published on May 7, 2009 Fujifilm Corp.
JP2009148908A Machine Translation (by EPO and Google)—published Jul. 9, 2009; Fuji Xerox Co Ltd.
JP2009154330 Machine Translation (by EPO and Google)—published Jul. 16, 2009; Seiko Epson Corp.
JP2009190375 Machine Translation (by EPO and Google)—published Aug. 27, 2009; Fuji Xerox Co Ltd.
JP2009202355 Machine Translation (by EPO and Google)—published Sep. 10, 2009; Fuji Xerox Co Ltd.
JP2009214318 Machine Translation (by EPO and Google)—published Sep. 24, 2009 Fuji Xerox Co Ltd.
JP2009214439 Machine Translation (by PlatPat English machine translation)—published Sep. 24, 2009 Fujifilm Corp.
JP2009226852 Machine Translation (by EPO and Google)—published Oct. 8, 2009; Hirato Katsuyuki, Fujifilm Corp.
JP2009233977 Machine Translation (by EPO and Google)—published Oct. 15, 2009; Fuji Xerox Co Ltd.
JP2009234219 Machine Translation (by EPO and Google)—published Oct. 15, 2009; Fujifilm Corp.
JP2010054855 Machine Translation (by PlatPat English machine translation)—published Mar. 11, 2010 Itatsu, Fuji Xerox Co.
JP2010105365 Machine Translation (by EPO and Google)—published May 13, 2010; Fuji Xerox Co Ltd.
JP2010173201 Abstract; Machine Translation (by EPO and Google)—published Aug. 12, 2010; Richo Co Ltd.
JP2010184376 Machine Translation (by EPO, PlatPat and Google)—published Aug. 26, 2010 Fujifilm Corp.
JP2010214885A Machine Translation (by EPO and Google)—published Sep. 30, 2010; Mitsubishi Heavy Ind Ltd.
JP2010228192 Machine Translation (by PlatPat English machine translation)—published Oct. 14, 2010 Fuji Xerox.
JP2010241073 Machine Translation (by EPO and Google)—published Oct. 28, 2010; Canon Inc.
JP2010247381A Machine Translation (by EPO and Google); published on Nov. 4, 2010, Ricoh Co Ltd.
JP2010258193 Machine Translation (by EPO and Google)—published Nov. 11, 2010; Seiko Epson Corp.
JP2010260204A Machine Translation (by EPO and Google)—published Nov. 18, 2010; Canon KK.
JP2010260287 Machine Translation (by EPO and Google)—published Nov. 18, 2010, Canon KK.
JP2011002532 Machine Translation (by PlatPat English machine translation)—published Jun. 1, 2011 Seiko Epson Corp.
JP2011025431 Machine Translation (by EPO and Google)—published Feb. 10, 2011; Fuji Xerox Co Ltd.
JP2011126031A Machine Translation (by EPO and Google); published on Jun. 30, 2011, Kao Corp.
JP2011144271 Machine Translation (by EPO and Google)—published Jun. 28, 2011 Toyo Ink SC Holdings Co Ltd.
JP2011173325 Abstract; Machine Translation (by EPO and Google)—published Sep. 8, 2011; Canon Inc.
JP2011173326 Machine Translation (by EPO and Google)—published Sep. 8, 2011; Canon Inc.
JP2011186346 Machine Translation (by PlatPat English machine translation)—published Sep. 22, 2011 Seiko Epson Corp, Nishimura et al.
JP2011189627 Machine Translation (by Google Patents)—published Sep. 29, 2011; Canon KK.
JP2011201951A Machine Translation (by PlatPat English machine translation); published on Oct. 13, 2011, Shin-Etsu Chemical Co Ltd, Todoroki et al.
JP2011224032 Machine Translation (by EPO and Google)—published Jul. 5, 2012 Canon KK.
JP2012086499 Machine Translation (by EPO and Google)—published May 10, 2012; Canon Inc.
JP2012111194 Machine Translation (by EPO and Google)—published Jun. 14, 2012; Konica Minolta.
JP2013001081 Machine Translation (by EPO and Google)—published Jan. 7, 2013; Kao Corp.
JP2013060299 Machine Translation (by EPO and Google)—published Apr. 4, 2013; Ricoh Co Ltd.
JP2013103474 Machine Translation (by EPO and Google)—published May 30, 2013; Ricoh Co Ltd.
JP2013121671 Machine Translation (by EPO and Google)—published Jun. 20, 2013; Fuji Xerox Co Ltd.
JP2013129158 Machine Translation (by EPO and Google)—published Jul. 4, 2013; Fuji Xerox Co Ltd.
JP2529651 B2 Machine Translation (by EPO and Google)—issued Aug. 28, 1996;Osaka Sealing Insatsu KK.
JPH05147208 Machine Translation (by EPO and Google)—published Jun. 15, 1993—Mita Industrial Co Ltd.
JPH06100807 Machine Translation (by EPO and Google)—published Apr. 12, 1994; Seiko Instr Inc.
JPH06345284A Machine Translation (by EPO and Google); published on Dec. 20, 1994, Seiko Epson Corp.

(56) References Cited

OTHER PUBLICATIONS

JPH07186453A Machine Translation (by EPO and Google)—published Jul. 25, 1995; Toshiba Corp.
JPH07238243A Machine Translation (by EPO and Google)—published Sep. 12, 1995; Seiko Instr Inc.
JPH08112970 Machine Translation (by EPO and Google)—published May 7, 1996; Fuji Photo Film Co Ltd.
JPH0862999A Machine Translation (by EPO & Google)—published Mar. 8, 1996 Toray Industries, Yoshida, Tomoyuki.
JPH09123432 Machine Translation (by EPO and Google)—published May 13, 1997, Mita Industrial Co Ltd.
JPH09281851A Machine Translation (by EPO and Google)—published Oct. 31, 1997; Seiko Epson Corp.
JPH09314867A Machine Translation (by PlatPat English machine translation)—published Dec. 9, 1997, Toshiba Corp.
JPH11106081A Machine Translation (by EPO and Google)—published Apr. 20, 1999; Ricoh KK.
JPH5297737 Machine Translation (by EPO & Google machine translation)—published Nov. 12, 1993 Fuji Xerox Co Ltd.
JPS5578904A Machine Translation (by EPO and Google)—published Jun. 14, 1980; Yokoyama Haruo.
JPS57121446U Machine Translation (by EPO and Google)—published Jul. 28, 1982.
JPS6076343A Machine Translation (by EPO and Google)—published Apr. 30, 1985; Toray Industries.
Machine Translation (by EPO and Google) of JPH07112841 published on May 2, 1995 Canon KK.
Marconi Studios, Virtual SET Real Time; http://www.marconistudios.il/pp./virtualset_en.php.
Poly(vinyl acetate) data sheet. PolymerProcessing.com. Copyright 2010. http://polymerprocessing.com/polymers/PV AC.html.
Royal Television Society, The Flight of the Phoenix; https://rts.org.uk/article/flight-phoenix, Jan. 27, 2011.
RU2180675 Machine Translation (by EPO and Google)—published Mar. 20, 2002; Zao Rezinotekhnika.
RU2282643 Machine Translation (by EPO and Google)—published Aug. 27, 2006; Balakovorezinotekhnika Aoot.
Thomas E. F., "CRC Handbook of Food Additives, Second Edition, vol. 1" CRC Press LLC, 1972, p. 434.
Units of Viscosity published by Hydramotion Ltd. 1 York Road Park, Malton, York Y017 6YA, England; downloaded from www.hydramotion.com website on Jun. 19, 2017.
WO2013087249 Machine Translation (by EPO and Google)—published Jun. 20, 2013; Koenig & Bauer AG.

* cited by examiner

SEGMENT LENGTHS CALCULATED FROM LOCAL VELOCITIES MEASURED DURING EACH TIME INTERVAL $TI_i$ $X_{SEG}(TI_i)_j$ IS CALCULATED FROM $V_j$ $X_{SEG}(TI_i)_{j+1}$ IS CALCULATED FROM $V_{j+1}$

SEGMENT LENGTHS $X_{SEG}(TI_1)$ .. $X_{SEG}(TI_M)$ CALCULATED FROM LOCAL VELOCITY MEASUREMENTS FOR THE IMMEDIATELY PRECEDING $M$ TIME INTERVALS $TI_1$ .. $TI_M$ ARE SUMMED TO OBTAIN A TIME-INTERVAL-SPECIFIC STRETCHED LENGTH ESTIMATE $X_{EST}(TI_i)$ [CAN BE PERFORMED AT UPSTREAM OR DOWNSTREAM ROLLER]

DIGITAL PRINTING SYSTEM WITH FLEXIBLE INTERMEDIATE TRANSFER MEMBER

CROSS-REFERENCE TO RELATED APPLICATIONS

This patent application claims the benefit of U.S. Provisional Patent Application No. 62/713,632 filed on Aug. 2, 2018, which is incorporated herein by reference in its entirety.

FIELD OF THE INVENTION

The present invention relates to systems and methods for controlling various aspects of a digital printing system that uses an intermediate transfer member. In particular, the present invention is suitable for printing systems in which images are formed by the deposition of ink droplets by multiple print bars, and in which it is desirable to adjust the spacing between ink droplets, in response to longitudinal stretching of the intermediate transfer member.

BACKGROUND

Various printing devices use an inkjet printing process, in which an ink is jetted to form an image onto the surface of an intermediate transfer member (ITM), which is then used to transfer the image onto a substrate. The ITM may be a flexible belt guided over rollers. The flexibility of the belt can cause a portion of the belt to become stretched longitudinally, and especially in the area of an image forming station wherein a drive roller that is downstream of the image-forming station can impart a higher velocity to the belt than an upstream drive roller, i.e., a drive roller that is upstream of the image-forming station. This difference in velocity at the drive rollers keeps a portion of the belt taut as it passes the print bars of the image-forming station. In some cases the tautness-making can lead to the aforementioned stretching. The terms 'longitudinally', 'upstream' and 'downstream' are used herein relative to the print direction, i.e., the travel direction of ink images formed upon the belt.

The portion of the belt that was stretched between the upstream and downstream drive rollers may become unstretched after passing the downstream drive roller, or stretched to a lesser degree, and when images are transferred from the belt to substrate at an impression station, inter-droplet spacing of an image may be different than it was at the time that the image was formed at the image-forming station. In other words, a stretch factor characterizing an extent of stretching at the impression station will often be different from a stretch factor characterizing an extent of stretching at the image-forming station. It is, therefore, necessary to compensate for the different stretching factors.

The following co-pending patent publications provide background material, and are all incorporated herein by reference in their entirety: WO/2017/009722 (publication of PCT/IB2016/053049 filed May 25, 2016), WO/2016/166690 (publication of PCT/IB2016/052120 filed Apr. 4, 2016), WO/2016/151462 (publication of PCT/IB2016/051560 filed Mar. 20, 2016), WO/2016/113698 (publication of PCT/IB2016/050170 filed Jan. 14, 2016), WO/2015/110988 (publication of PCT/IB2015/050501 filed Jan. 22, 2015), WO/2015/036812 (publication of PCT/IB2013/002571 filed Sep. 12, 2013), WO/2015/036864 (publication of PCT/IB2014/002366 filed Sep. 11, 2014), WO/2015/036865 (publication of PCT/IB2014/002395 filed Sep. 11, 2014), WO/2015/036906 (publication of PCT/IB2014/064277 filed Sep. 12, 2014), WO/2013/136220 (publication of PCT/IB2013/051719 filed Mar. 5, 2013), WO/2013/132419 (publication of PCT/IB2013/051717 filed Mar. 5, 2013), WO/2013/132424 (publication of PCT/IB2013/051727 filed Mar. 5, 2013), WO/2013/132420 (publication of PCT/IB2013/051718 filed Mar. 5, 2013), WO/2013/132439 (publication of PCT/IB2013/051755 filed Mar. 5, 2013), WO/2013/132438 (publication of PCT/IB2013/051751 filed Mar. 5, 2013), WO/2013/132418 (publication of PCT/IB2013/051716 filed Mar. 5, 2013), WO/2013/132356 (publication of PCT/IB2013/050245 filed Jan. 10, 2013), WO/2013/132345 (publication of PCT/IB2013/000840 filed Mar. 5, 2013), WO/2013/132339 (publication of PCT/IB2013/000757 filed Mar. 5, 2013), WO/2013/132343 (publication of PCT/IB2013/000822 filed Mar. 5, 2013), WO/2013/132340 (publication of PCT/IB2013/000782 filed Mar. 5, 2013), and WO/2013/132432 (publication of PCT/IB2013/051743 filed Mar. 5, 2013).

SUMMARY

A method of printing is disclosed according to embodiments. The method uses a printing system that comprises (i) a flexible intermediate transfer member (ITM) disposed around a plurality of guide rollers including an upstream guide roller and a downstream guide roller, at which respective upstream and downstream encoders are installed, and (ii) an image-forming station at which ink images are formed by droplet deposition, the image-forming station comprising an upstream print bar and a downstream print bar, the upstream and downstream print bars being disposed over the ITM and respectively aligned with the upstream and downstream guide rollers, the upstream and downstream print bars defining a reference portion RF of the ITM. The method comprises (a) measuring a local velocity V of the ITM under at least one of the upstream and downstream print bars at least once during each time interval $TI_i$, each time interval $TI_i$ being one of M consecutive preset divisions of a predetermined time period TT, where M is a positive integer; (b) determining a respective time-interval-specific stretch factor $SF(TI_i)$ for the reference portion RF, based on a mathematical relationship between a time-interval-specific stretched length $X_{EST}(TI_i)$ and a fixed physical distance $X_{FIX}$ between the upstream and downstream print bars; and (c) controlling an ink deposition parameter of the downstream print bar according to the determined time-interval-specific stretch factor $SF(TI_i)$, so as to compensate for stretching of the reference portion of the ITM.

In some embodiments, the time-interval-specific stretched length $X_{EST}(TI_i)$ can be obtained by summing, for the immediately preceding M time intervals $TI_i$, respective segment-lengths $X_{SEG}(TI_i)$ calculated from the local velocities V measured during each time interval $TI_i$, wherein the calculating includes the use of at least one of a summation, a product, and an integral.

In some embodiments, the ink deposition parameter can be a spacing between respective ink droplets deposited by upstream and downstream print bars onto the ITM.

In some embodiments, it can be that every time interval $TI_i$ is one Mth of the predetermined time period TT. In some embodiments, the predetermined time period TT can be a measured travel time of a portion of the ITM from the upstream print bar to the downstream print bar. The portion of the ITM can be the reference portion RF of the ITM.

In some embodiments, M can equal 1. In some embodiments, M can be greater than 1 and not greater than 10. In some embodiments, M can be greater than 10 and not greater than 1,000.

A method of printing is disclosed, according to embodiments. The method uses a printing system that comprises (i) an image-forming station at which ink images are formed by droplet deposition on a rotating flexible intermediate transfer member (ITM), and (ii) an impression station downstream of the image-forming station at which the ink images are transferred to substrate. The method comprises (a) tracking a stretch-factor ratio between a first measured or estimated local stretch factor of the ITM at the image-forming station and a second measured or estimated local stretch factor of the ITM at the impression station; and (b) in response to and in accordance with detected changes in the tracked stretch factor ratio, controlling deposition of droplets onto the ITM at the imaging station so as to modify a spacing between ink droplets in ink images formed on the ITM at the imaging station.

In some embodiments, the method can additionally comprise the steps of (a) transporting the ink images formed on the ITM at the imaging station to the impression station; and (b) transferring the ink images to substrate at the impression station, such that a spacing between ink droplets in ink images when transferred to substrate at the impression station is different than the spacing between the respective ink droplets when the ink images were formed at the image-forming station. The spacing between ink droplets in ink images when transferred to substrate at the impression station can be smaller than the spacing between the respective ink droplets when the ink images were formed at the image-forming station.

In some embodiments, it can be that (i) the image-forming station of the printing system comprises a plurality of print bars, and (ii) the tracking a stretch-factor ratio between a measured or estimated local stretch factor of the ITM at the image-forming station and a measured or estimated local stretch factor of the ITM at the impression station includes tracking a respective stretch-factor ratio between a measured or estimated local stretch factor of the ITM at each print bar of the image-forming station and a measured or estimated local stretch factor of the ITM at the impression station.

A method of printing is disclosed, according to embodiments. The method uses a printing system that comprises (i) an image-forming station at which ink images are formed by droplet deposition on a rotating flexible intermediate transfer member (ITM), and (ii) an impression station downstream of the image-forming station at which the ink images are transferred to substrate. The method comprises (a) tracking a first ITM stretch factor at the image-forming station and a second ITM stretch factor at the impression station, the second ITM stretch factor being different than the first ITM stretch factor; (b) forming the ink images at the image-forming station with a droplet-to-droplet spacing according to the first ITM stretch factor; and (c) transferring the ink images to substrate at the impression station with a droplet-to-droplet spacing according to the second ITM stretch factor.

In some embodiments, the second stretch factor can be smaller than the first ITM stretch factor.

In some embodiments, it can be that (i) the image-forming station of the printing system comprises a plurality of print bars, (ii) tracking a first ITM stretch factor at the image-forming station includes tracking a respective first ITM stretch factor at each print bar of the image-forming station, and (iii) forming the ink images at the image-forming station with a droplet-to-droplet spacing according to the first ITM stretch factor includes forming the ink images at each print bar of the image-forming station with a droplet-to-droplet spacing according to the first ITM stretch factor corresponding to the respective print bar.

A method of printing an image is disclosed, according to embodiments. The method uses a printing system that comprises (i) an intermediate transfer member (ITM) comprising a flexible endless belt mounted over a plurality of guide rollers, (ii) an image-forming station comprising a print bar disposed over a surface of the ITM, the print bar configured to form ink images upon a surface of the ITM by droplet deposition, and (iii) a conveyer for driving rotation of the ITM in a print direction to transport the ink images towards an impression station where they are transferred to substrate. The method comprises (a) depositing ink droplets, by the print bar, so as to form an ink image on the ITM with at least a part of the ink image characterized by a first between-droplet spacing in the print direction; (b) transporting the ink image, by the ITM, to the impression station; and (c) transferring the ink image to substrate at the impression station with a second between-droplet spacing in the print direction, wherein the first between-droplet spacing in the print direction is in accordance with data associated with stretching of the ITM at the print bar.

In some embodiments, the second between-droplet spacing can be smaller than the first between-droplet spacing. In some embodiments the first between-droplet spacing in the print direction can change from time to time.

In embodiments, a printing system comprises (a) a flexible intermediate transfer member (ITM) disposed around a plurality of guide rollers including upstream and downstream guide rollers at which upstream and downstream encoders are respectively installed; (b) an image-forming station at which ink images are formed by droplet deposition, the image-forming station comprising an upstream print bar and a downstream print bar, the upstream and downstream print bars disposed over the ITM and respectively aligned with the upstream and downstream guide rollers, the upstream and downstream print bars (i) having a fixed physical distance $X_{FIX}$ therebetween and (ii) defining a reference portion RF of the ITM; and (c) electronic circuitry for controlling a spacing between respective ink droplets deposited by the upstream and downstream print bars onto the ITM and other ink droplets according to a calculated time-interval-specific stretch factor $SF(TI_i)$ so as to compensate for stretching of the reference portion RF of the ITM, wherein (i) a time-interval-specific stretch factor $SF(TI_i)$ for each time interval $TI_i$ is based on a mathematical relationship between an estimated time-interval-specific stretched length $X_{EST}(TI_i)$ and fixed physical distance $X_{FIX}$, the time-interval-specific stretched length $X_{EST}(TI_i)$ being the sum of M segment-lengths $X_{SEG}(TI_i)$ corresponding to local velocities V measured under at least one of the upstream and downstream print bars at least once during each respective time interval $TI_i$, and (ii) each respective time interval $TI_i$ is one of M consecutive preset divisions of a predetermined time period TT, M being a positive integer.

In embodiments, a printing system comprises (a) an image-forming station at which ink images are formed by droplet deposition on a rotating flexible intermediate transfer member (ITM); (b) an impression station downstream of the image-forming station, at which the ink images are transferred to substrate; and (c) electronic circuitry configured to track a stretch-factor ratio between a measured or estimated local stretch factor of the ITM at the image-forming station and a measured or estimated local stretch factor of the ITM at the impression station, and, in response to and in accordance with detected changes in the tracked stretch factor ratio, control deposition of droplets onto the ITM at the imaging station so as to modify a spacing between ink droplets in ink images formed on the ITM at the imaging station.

In some embodiments, the electronic circuitry can be configured such that modifying of a spacing between ink droplets in ink images formed on the ITM at the imaging station is such that the spacing between ink droplets in ink images formed on the ITM is larger than a spacing between the droplets in the ink images when transferred to substrate at the impression station.

In embodiments, a printing system comprises (a) an image-forming station at which ink images are formed by droplet deposition on a rotating flexible intermediate transfer member (ITM); (b) electronic circuitry configured to track a first ITM stretch factor at the image-forming station and a second ITM stretch factor at an impression station downstream of the image-forming station at which the ink images are transferred to substrate, and to control deposition of droplets onto the ITM at the imaging station so as to modify a spacing between ink droplets in accordance with the first ITM stretch factor; and (c) the impression station, at which the ink images are transferred to substrate with a spacing between ink droplets in accordance with the second stretch factor.

In some embodiments, the second stretch factor can be smaller than the first ITM stretch factor.

In embodiments, a printing system comprises (a) an intermediate transfer member (ITM) comprising a flexible endless belt mounted over a plurality of guide rollers and rotating in a print direction; (b) an image-forming station comprising a print bar disposed over a surface of the ITM, the print bar configured to deposit droplets upon a surface of the ITM so as to form ink images characterized at least in part by a first between-droplet spacing in the print direction which is selected in accordance with in accordance with data associated with stretching of the ITM at the print bar; and (c) a conveyer for driving rotation of the ITM in a print direction to transport the ink images towards an impression station where they are transferred to substrate with a second between-droplet spacing in the print direction.

In some embodiments, the second between-droplet spacing can be smaller than the first between-droplet spacing.

BRIEF DESCRIPTION OF THE DRAWINGS

The invention will now be described further, by way of example, with reference to the accompanying drawings, in which the dimensions of components and features shown in the figures are chosen for convenience and clarity of presentation and not necessarily to scale. In the drawings.

DETAILED DESCRIPTION OF THE EMBODIMENTS

Figure 1:
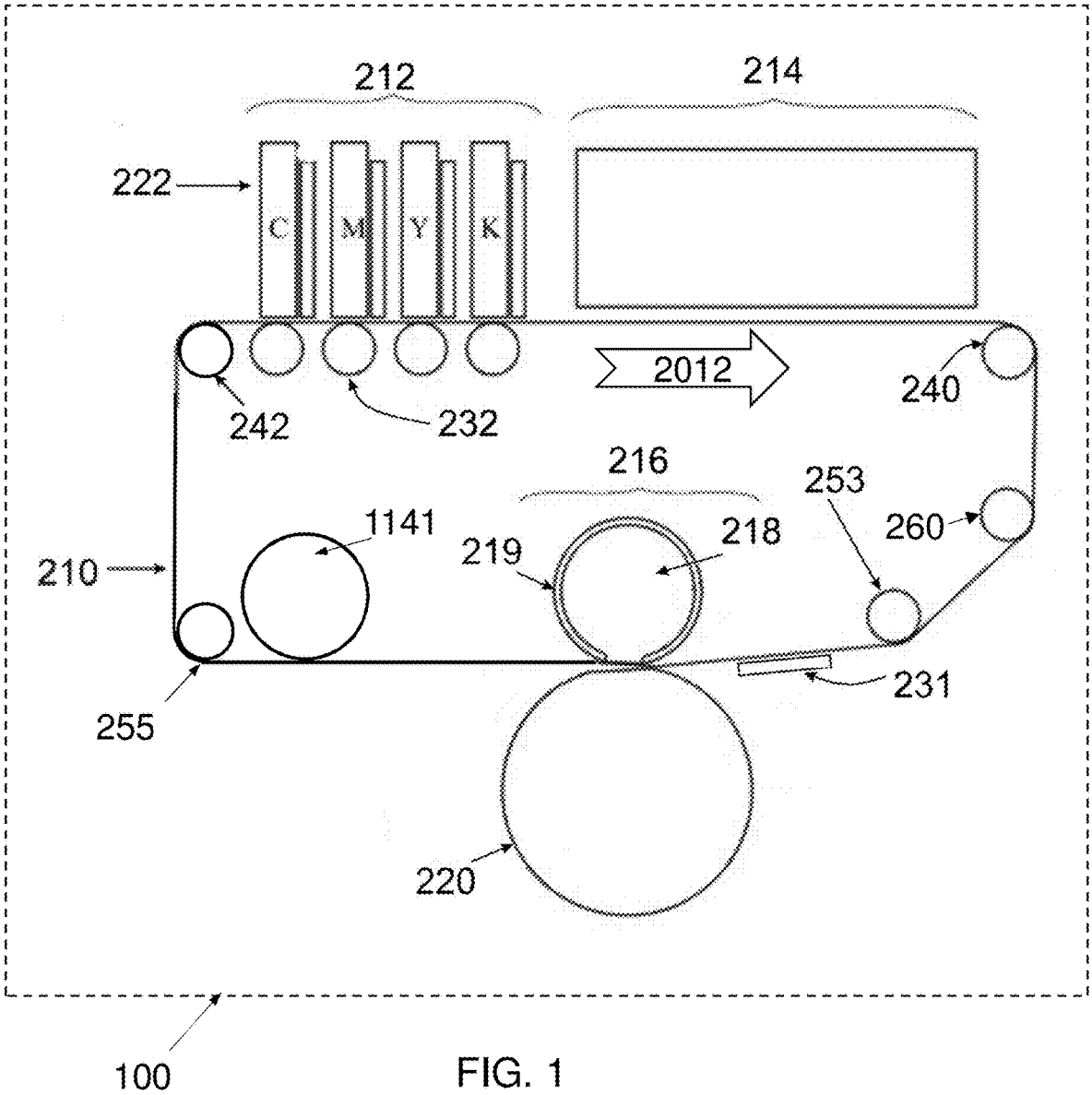
FIGS. 1 and 2 are schematic elevation-view illustrations of printing systems according to embodiments.

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are generally used to designate like elements. Subscripted reference numbers (e.g., 101) or letter-modified reference numbers (e.g., 100*a*) may be used to designate multiple separate appearances of elements in a single drawing, e.g. 101 is a single appearance (out of a plurality of appearances) of element 10, and likewise 100*a* is a single appearance (out of a plurality of appearances) of element 100.

For convenience, in the context of the description herein, various terms are presented here. To the extent that definitions are provided, explicitly or implicitly, here or elsewhere in this application, such definitions are understood to be consistent with the usage of the defined terms by those of skill in the pertinent art(s). Furthermore, such definitions are to be construed in the broadest possible sense consistent with such usage.

A "controller" or, alternately, "electronic circuitry", as used herein is intended to describe any processor, or computer comprising one or more processors, configured to control one or more aspects of the operation of a printing system or of one or more printing system components according to program instructions that can include rules, machine-learned rules, algorithms and/or heuristics, the programming methods of which are not relevant to this invention. A controller can be a stand-alone controller with a single function as described, or alternatively can combine more than one control function according to the embodiments herein and/or one or more control functions not related to the present invention or not disclosed herein. For example, a single controller may be provided for controlling all aspects of the operation of a printing system, the control functions described herein being one aspect of the control functions of such a controller. Similarly, the functions disclosed herein with respect to a controller can be split or distributed among more than one computer or processor, in which case any such plurality of computers or processors are to be construed as being equivalent to a single computer or processor for the purposes of this definition. For purposes of clarity, some components associated with computer networks, such as, for example, communications equipment and data storage equipment, have been omitted in this specification but a skilled practitioner will understand that a controller as used herein can include any network gear or ancillary equipment necessary for carrying out the functions described herein.

In various embodiments, an ink image is first deposited on a surface of an intermediate transfer member (ITM), and transferred from the surface of the intermediate transfer member to a substrate (i.e. sheet substrate or web substrate). For the present disclosure, the terms "intermediate transfer member", "image transfer member" and "ITM" are synonymous and may be used interchangeably. The location at which the ink is deposited on the ITM is referred to as the "image forming station". In many embodiments, the ITM comprises a "belt" or "endless belt" or "blanket" and these terms may be used interchangeably with ITM. The area or region of the printing press at which the ink image is transferred to substrate is an "impression station". It is appreciated that for some printing systems, there may be a plurality of impression stations.

The terms 'longitudinally' and 'longitudinal' refer to a direction that is parallel to the direction of travel of an intermediate transfer member (ITM) in a printing system.

Referring now to the figures, FIG. 1 is a schematic diagram of a printing system 100 according to embodiments of the present invention. The printing system 100 of FIG. 1 comprises an intermediate transfer member (ITM) 210 comprising a flexible endless belt mounted over a plurality of rollers 232 ($\mathbf{232}_1 \ldots \mathbf{232}_N$), 240, 260, 253, 255, 242. Some of the rollers may be drive rollers activated by an electric motor, and others may be passive guide rollers. FIG. 1 shows aspects of a specific configuration relevant to discussion of the invention, and the shown configuration is not limited to the presented number and disposition of the rollers, nor is it limited to the shape and relative dimensions, all of which are shown here for convenience of illustrating the system components in a clear manner.

In the example of FIG. 1, the ITM 210 rotates in the clockwise direction relative to the drawing. The direction of belt movement, which is also called the "print direction" as it's the direction of circumferential travel from an image-processing station 212 towards an impression station 216, defines upstream and downstream directions. The print direction is shown in FIG. 1 by arrow 2012, and in FIG. 2 by arrow 150. Regardless of whether a print direction is illustrated in any particular figure, the convention throughout all figures in this disclosure is that print direction is to be understood as being clockwise in any figure or portion thereof wherein an entire ITM or printing system is shown, as left-to-right wherever an upper run of an ITM or other printing system components are shown, and right-to-left where a bottom run of a printing system is shown. Obviously, this is just a convention to achieve a consistency that aids ease of understanding the disclosure, and even the same printing system, if illustrated 'from the other side', would show the reverse direction of travel.

Rollers 242, 240 are respectively positioned upstream and downstream of the image forming station 212—thus, roller 242 may be referred to as a "upstream roller" while roller 240 may be referred to as a "downstream roller". In some embodiments, downstream roller 240 can be a "drive roller", i.e., a roller that drives the rotation of the ITM 210 because it is engaged with a motor or other conveying mechanism. Upstream roller 242 can also be a drive roller. In other embodiments these two rollers can be unpowered guide rollers, i.e., guide rollers are rollers which rotate with the passage thereupon (or therearound) of the ITM 210 and don't accelerate or regulate the velocity of the ITM 210. Any one or more of the other rollers 232, 260, 253, 255 can be drive rollers or guide rollers depending on system design. For any two rollers, it is possible to view one as a downstream roller and one as an upstream roller, according to the direction of travel of the ITM 210 (e.g., the print direction 1200).

In FIG. 1, the illustrated printing system 100 further comprises the following elements:

(a) the image forming station 212 mentioned earlier, which comprises, for example, print bars 222 (respectively $\mathbf{222}_1$, $\mathbf{222}_2$, $\mathbf{222}_3$ and $\mathbf{222}_4$) each noted in the figure as one of C, M Y and K—for cyan, magenta, yellow and black. The image forming station 212 is configured to form ink images (NOT SHOWN) upon a surface of the ITM 210 (e.g., by droplet deposition thereon).

(b) a drying station 214 for drying the ink images.

(c) the impression station 216, also mentioned earlier, where the ink images are transferred from the surface of the ITM 210 to sheet 231 or web substrate (only sheet substrate is illustrated in FIG. 1).

In the particular non-limiting example of FIG. 1, the impression station 216 comprises an impression cylinder 220 and a blanket/pressure cylinder 218 that carries a compressible layer 219.

The skilled artisan will appreciate that not every component illustrated in FIG. 1 is required, and that a complex digital printing system such as that illustrated in FIG. 1 can comprise additional components which are not shown because they are not relevant to the present disclosure.

Figure 2:
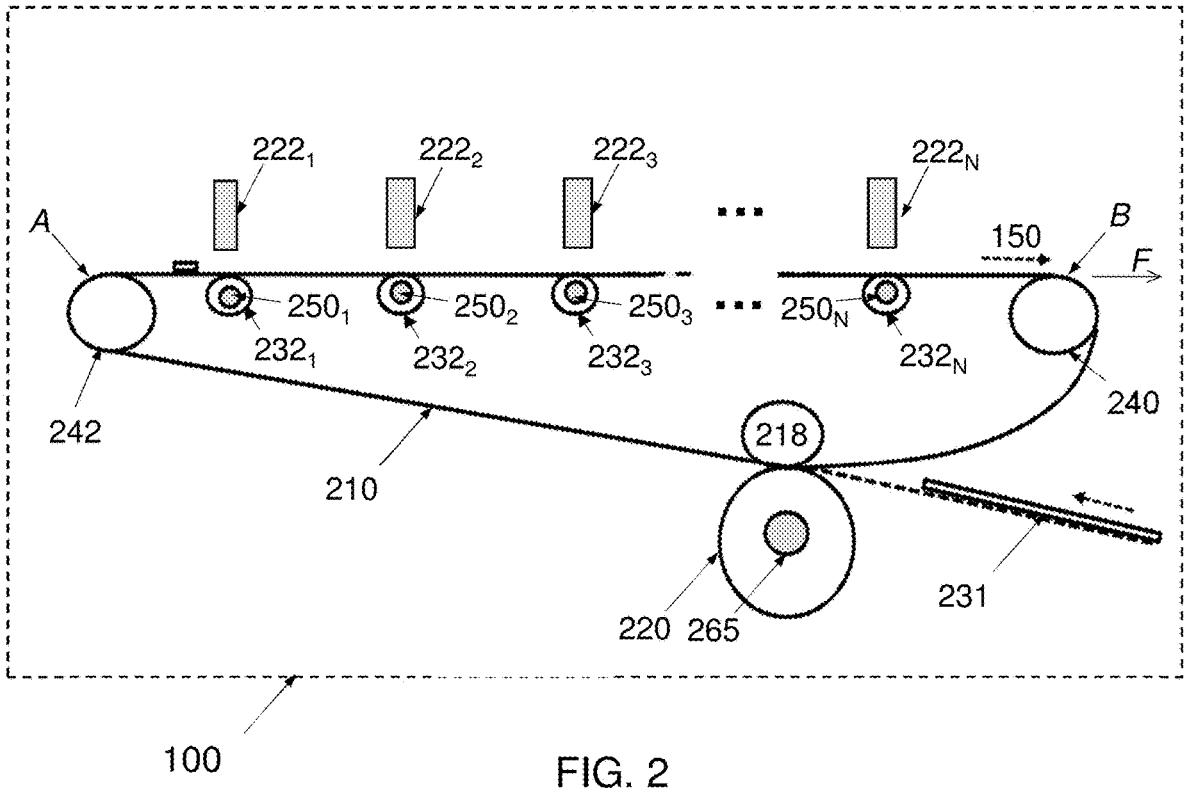
Figure 3A:
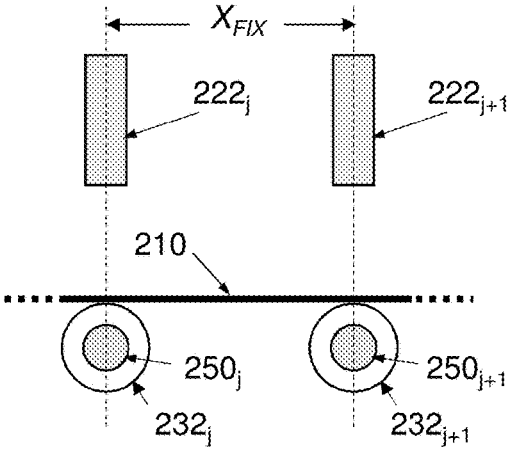
FIGS. 3A, 3B, 4A and 4B are schematic elevation-view illustrations of print bar and guide roller components of a printing system, according to embodiments.
Figure 3B:
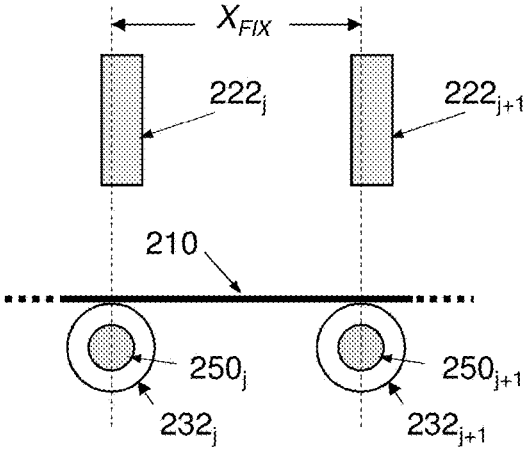

FIG. 2 illustrates, schematically, another non-limiting example of a printing system 100 according to embodiments. Print bars $\mathbf{222}_1 \ldots \mathbf{222}_N$ are disposed above a surface of the ITM 210. Each respective one of guide rollers $\mathbf{232}_1 \ldots \mathbf{232}_N$ is 'aligned' with a corresponding one of print bars $\mathbf{222}_1 \ldots \mathbf{222}_N$. For the purposes of this disclosure, 'corresponding' means that, by way of example, guide roller $\mathbf{232}_1$ corresponds to print bar $\mathbf{222}_1$, guide roller 2322 corresponds to print bar $\mathbf{222}_2$, and so on. Each guide roller 232 comprises an encoder 250, i.e., a respective one of encoders $\mathbf{250}_1 \ldots \mathbf{250}_N$. An encoder, as in the example illustrated in FIG. 2, can be a rotary encoder. A rotary encoder, as is known in the art, can be used, inter alia, for measuring rotational speed, and for communicating the rotational speed to a controller (not shown in FIG. 2) for recordation and/or for further data processing). Although not shown in FIG. 2, each drive roller 240, 242 may also include an encoder. What is meant by 'aligned' is that the placement of each print bar 222 relative to a corresponding guide roller 232 (or, alternatively, the placement of each guide roller 232 relative to a corresponding each print bar 222) is based on a pre-determined and fixed spatial relationship. For example, as illustrated in FIG. 3A, each of neighboring print bars $\mathbf{222}_j$ or $\mathbf{222}_{j+1}$ (two of the print bars $\mathbf{222}_1 \ldots \mathbf{222}_N$) is aligned centerline-to-centerline above respective guide roller $\mathbf{232}_j$ or $\mathbf{232}_{j+1}$. The fixed physical distance between the print bars on a horizontal plane, centerline-to-centerline, is shown in FIG. 3A as $X_{FIX}$. In some embodiments the fixed physical distance between each two neighboring print bars 222 of all the print bars $\mathbf{222}_1 \ldots \mathbf{222}_N$ can be the same $X_F$IX, and in other embodiments (not shown) there can be a different fixed physical distance $X_{FIXj,j+1}$ between each pair of neighboring print bars $\mathbf{222}_j$, $\mathbf{222}_{j+1}$ for each print bar $\mathbf{222}_j$. The alignment of print bars with corresponding guide rollers is not necessarily centerline-to-centerline: FIG. 3B illustrates a non-limiting example in which the vertical alignment is such that the actual centerline of each guide roller 232, if extended vertically, would pass somewhat left of a vertical centerline of each corresponding print bar 222. Obviously, the vertically-extended centerline of each guide roller could pass somewhat right of the vertical centerline, or might even not pass through the print bar but instead adjacent to it. In any of these cases, as exemplified in FIG. 3B, the horizontal distance from print bar $\mathbf{222}_j$ to print bar $\mathbf{222}_{j+1}$ is still defined by a fixed physical distance $X_{FIX}$, and once again it is noted that in some embodiments the fixed physical distance between each two neighboring print bars 222 of all the print bars $\mathbf{222}_1 \ldots \mathbf{222}_N$ can be the same $X_{FIX}$, or not.

Referring again to FIG. 2, a downstream drive roller 240 according to embodiments can have a higher rotational velocity than an upstream drive roller 242. The result of the difference in rotational velocities is that upstream drive roller 242 has the effect of being a 'drag' on the ITM 210. This can be 'designed-in' to the operation of the printing system 100 as a way of applying or maintaining a longitudinal tension force F in the ITM 210 that helps ensure that the ITM 210 is taut as it passes through the image-forming station 212 and under the print bars $\mathbf{222}_1 \ldots \mathbf{222}_N$. The longitudinal tension force, the direction of which is indicated in FIG. 2 by the arrow marked F (the arrow shows only direction and does not indicate location or magnitude), propagates through the section of the ITM 210 that is between downstream drive roller 240 and upstream drive roller 242, i.e., the section between Points A and B in FIG. 2, and as a result the surface velocity of the ITM 210 monotonically increases from Point A to Point B. (Note: for the purpose of this discussion, Points A and B might be anywhere along the arcs where ITM 210 is in contact with the respective drive rollers 240, 242, and the precise location along each respective arc can be calculated but is not particularly relevant here.) This means that for every adjacent two guide rollers 232, the ITM 210 will have a higher velocity at the more downstream one than at the more upstream one, and the more downstream one will have a higher rotational velocity than the more upstream one. In an alternative embodiment (not shown) which produces the same resulting longitudinal tension force, the downstream roller 240 can have the same rotational velocity as upstream roller 242 (or even a smaller rotation velocity than upstream roller 242) if downstream roller 240 has a larger diameter than upstream roller 242.

Figure 4A:
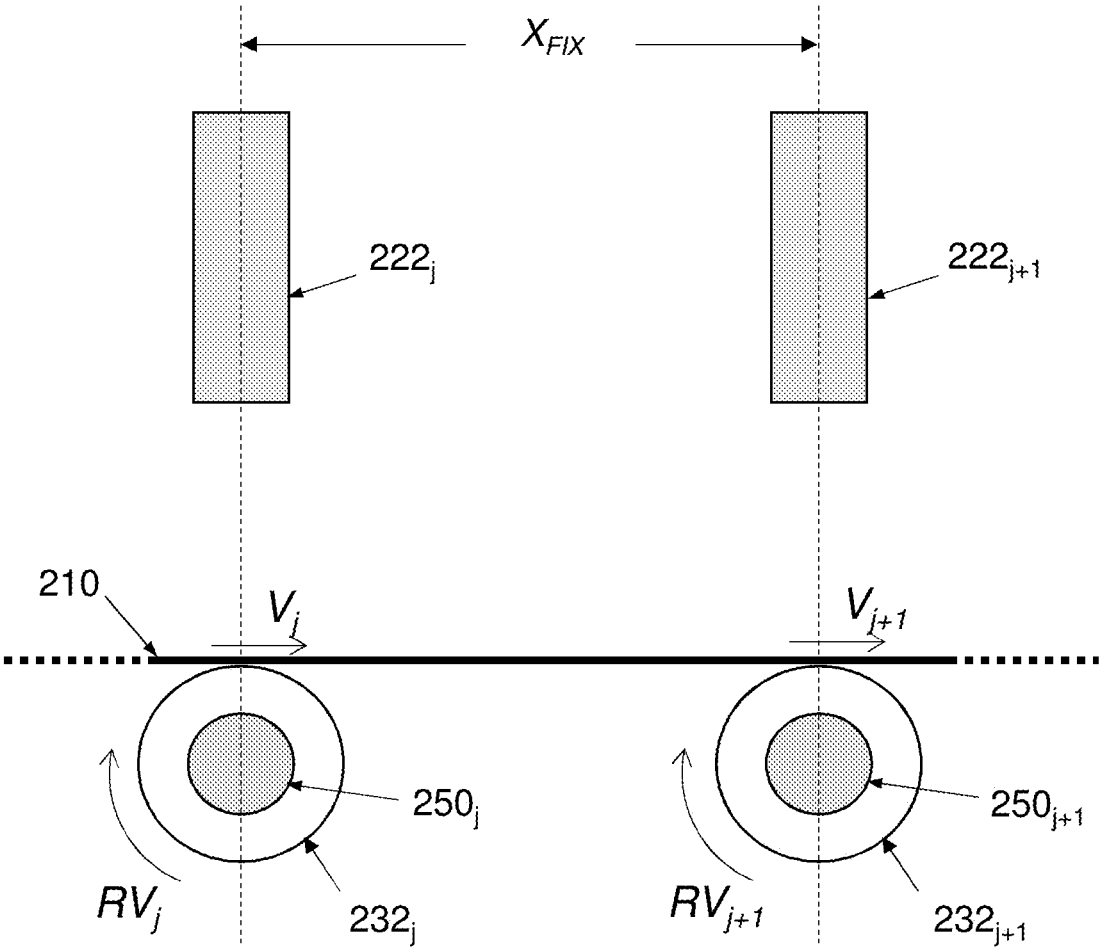

Referring now to FIG. 4A, neighboring print bars $\mathbf{222}_j$ and $\mathbf{222}_{j+1}$ are respectively aligned with neighboring guide rollers $\mathbf{232}_j$ and $\mathbf{232}_{j+1}$. A local linear velocity of the ITM 210 at the downstream guide roller $\mathbf{232}_{j+1}$ is $V_{j+1}$, and a local linear velocity of the ITM 210 at the upstream guide roller $\mathbf{232}_j$ is $V_j$. The travel of the ITM 210 at these respective velocities causes downstream neighboring print bar $\mathbf{222}_{j+1}$ to rotate with rotational velocity $RV_{j+1}$ and upstream neighboring print bar $\mathbf{222}_j$ to rotate with rotational velocity $RV_j$. Downstream guide roller $\mathbf{232}_{j+1}$ includes encoder $\mathbf{250}_{j+1}$, and upstream guide roller $\mathbf{232}_j$ includes encoder $\mathbf{250}_j$. Each encoder 250 is operative to record (or, alternatively and equivalently, cause to record, or be used in the recording of) the respective rotational velocity RV of corresponding guide roller 232 in real time, with the frequency of such recording (e.g., number of values recorded per minute or per second) being a design choice. The recording can be in a non-transitory computer storage medium to enable later analysis or other purposes, or can be in a transitory computer storage medium for use in further calculations that may use rotational velocity of guide rollers, or in both. For example, each rotational velocity RV value can be used to determine a local ITM 210 linear velocity V at each respective guide roller 232. The determining can be done by a controller or other electronic circuitry (not shown in FIG. 4A), as will be discussed later in this disclosure, which can be configured to calculate a linear velocity V of the ITM 210 from a rotational velocity RV by using a known diameter or radius of a respective roller 232 in which an encoder 250 is installed. In other words, a rotational velocity RV can be 'translated' to a linear velocity V in a straightforward manner.

Referring again to FIG. 2, longitudinal tension force F, imparted by the difference in rotational velocities of the drive rollers 240, 242, keeps the ITM 210 taut. Because of longitudinal elasticity of the ITM 210, the tension force F can cause the section of the ITM 210 between Points A and B to become not only taut, but also longitudinally stretched. Estimating the extent of this stretching can be a useful step in controlling the deposition of ink droplets onto the ITM 210 so as to compensate for the stretching. One way of estimating the extent of the stretching is to derive a stretch factor for each print bar, preferably a print-bar-specific stretch factor that is valid and applicable at a given point in time or during a given time interval. A stretch factor can be used, inter alia, to control the spacing of ink droplets deposited onto ITM 210 so as to compensate for the stretching. The skilled artisan will appreciate that stretching of an ITM 210 at any point along its length can also be increased or mitigated by other factors such as, for example, temperature, humidity, friction at the guide rollers, cleanliness of any of the relevant components; i.e., the difference in rotational velocity (and/or diameter) of the drive rollers 240, 242 may not be the only contributory factor to the stretching, but this does not affect the efficacy of the methods and systems described herein.

Figure 4B:
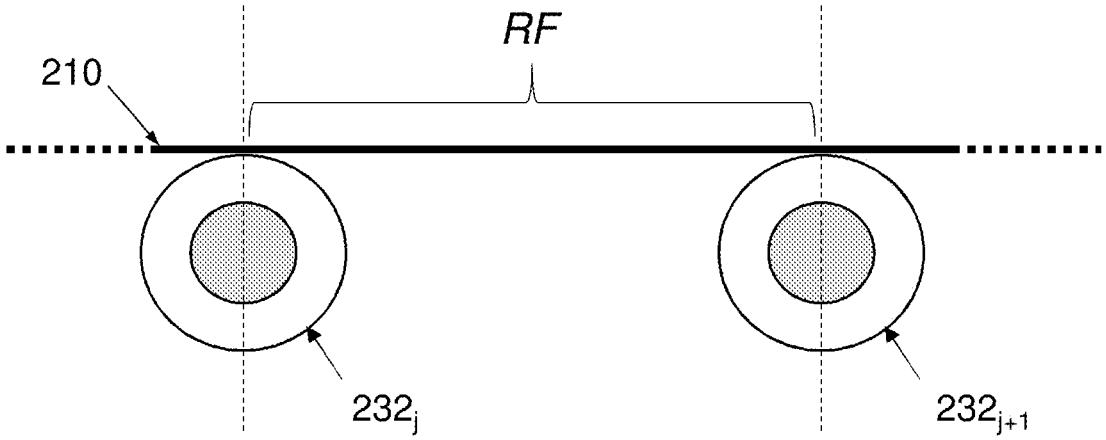

FIG. 4B illustrates the neighboring guide rollers $\mathbf{232}_j$ and $\mathbf{232}_{j+1}$ of FIG. 4A, and shows a reference portion RF of the ITM 210 between the two guide rollers $\mathbf{232}_j$ and $\mathbf{232}_{j+1}$. Reference portion RF of the ITM 210 is a physical segment of the ITM 210 which at times can be equal in length to the fixed physical distance $X_{FIX}$ between corresponding print bars $\mathbf{222}_j$ and $\mathbf{222}_{j+1}$ of FIG. 4A, and which at other times can be a different length than $X_{FIX}$ because of the aforementioned longitudinal stretching. Whilst FIG. 4B (taken in combination with FIG. 4A) shows RF and $X_{FIX}$ as being of equal length, this is shown for convenience only and illustrates only one idealized situation. The actual length of the reference portion RF, whether stretched or unstretched, can be estimated at any given time and used as an indication of stretching of the ITM 210 at the downstream print bar $\mathbf{222}_{j+1}$. As a non-limiting example, the integral of the linear velocity $V_{j+1}$ of the ITM 210 at downstream drive roller $\mathbf{232}_{j+1}$, i.e., as the ITM 210 passes downstream print bar $\mathbf{222}_{j+1}$ and downstream drive roller $\mathbf{232}_{j+1}$, can be taken over a time interval TT. As another non-limiting example, the integral of the linear velocity $V_j$ of the ITM 210 at upstream drive roller $\mathbf{232}_j$, i.e., as the ITM 210 passes upstream print bar $\mathbf{222}_j$ and upstream drive roller $\mathbf{232}_j$, can be taken over a time interval TT. An example of a time interval TT is a time interval that represents a nominal travel time of a length of ITM 210 equivalent in length to the reference portion RF over a fixed distance such as $X_{FIX}$. The nominal travel time can be derived, in a non-limiting example, by estimating or calculating a nominal system-wide velocity of the ITM 210, e.g., the total length of the ITM 210 divided by a designed or observed time for the ITM 210 to make a complete revolution. In other examples, TT can be obtained in other ways, for example by experimentation with an operating printing system 100.

In embodiments, a first estimated length or 'downstream-based' estimated length $X_{EST}(TT)_{j+1}$ is calculated by integrating velocity measurements $V_{j+1}$ (the velocity under downstream print bar $\mathbf{222}_{j+1}$) over a time interval TT corresponding to the travel time of the reference portion RF at a pre-determined velocity. $X_{EST}(TT)_{j+1}$ is the time-interval-specific (i.e., specific to time period TT) estimated stretched length of the reference portion RF. In other embodiments, a second estimated length or 'upstream-based' estimated length $X_{EST}(TT)_j$ of the reference portion RF is calculated by integrating velocity measurements $V_j$ (the velocity of the ITM 210 under upstream print bar $\mathbf{222}_j$) over the same time interval TT. The propagation of the tension force F through the reference portion RF produces an increase in velocity along the distance traveled from upstream print bar $\mathbf{222}_j$ to downstream print bar $\mathbf{222}_{j+1}$; therefore, downstream velocity $V_{j+1}$ at the downstream roller $\mathbf{232}_{j+1}$ is higher than upstream velocity $V_j$ at upstream roller $\mathbf{232}_j$, and the downstream-based estimated length $X_{EST}(TT)_{j+1}$ is therefore greater than upstream-based estimated length $X_{EST}(TT)_j$. As previously noted, this force F is due to the rotational velocity (and/or diameter) of downstream drive roller 240 being greater than that of upstream drive roller 242. The increase in velocity can be a linear function of the distance from upstream print bar $\mathbf{222}_j$.

Figure 5:
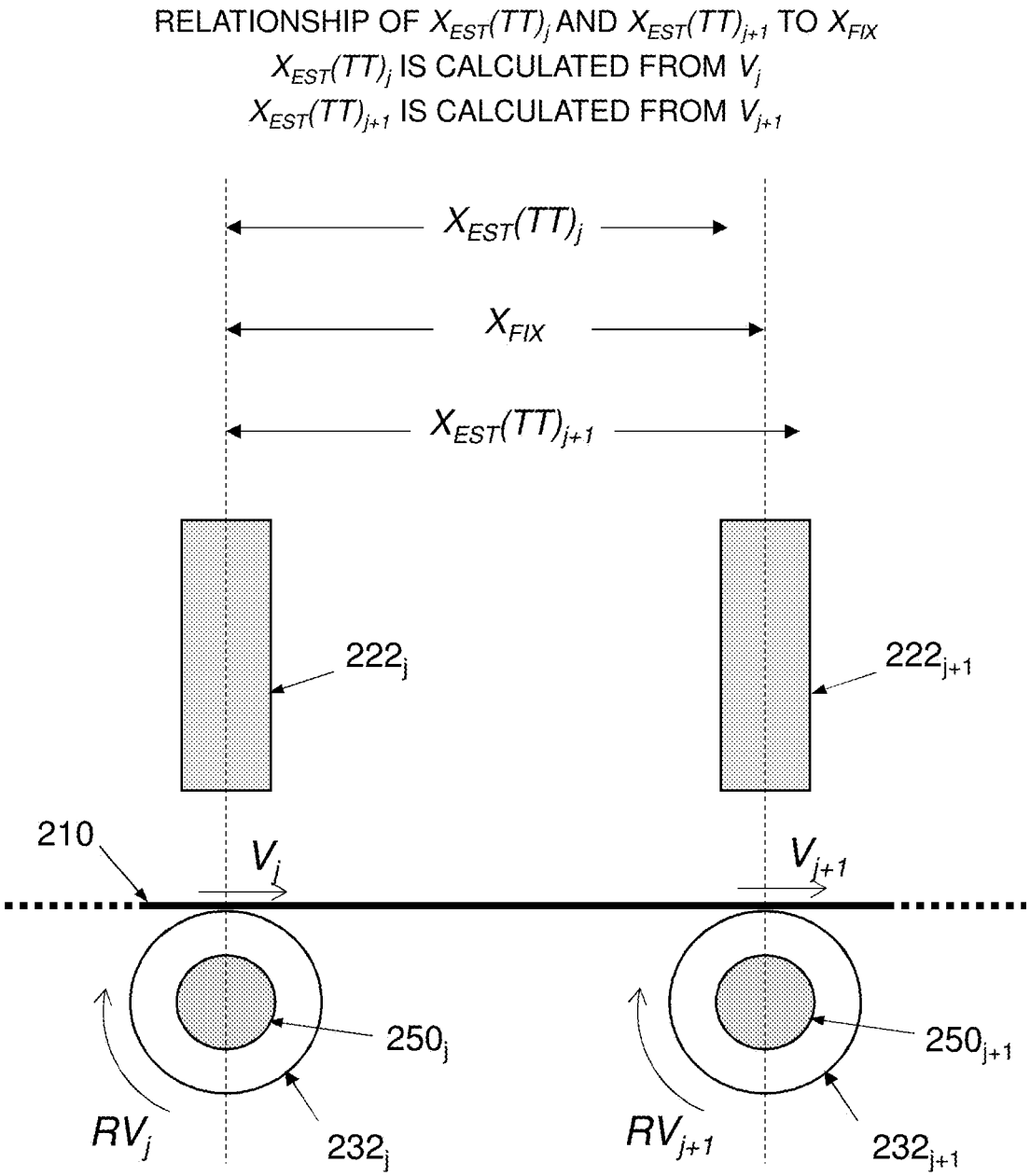
FIGS. 5 and 6 are schematic elevation-view illustrations of print bar and guide roller components of a printing system, showing comparisons of physical and estimated or calculated length and distance variables, according to embodiments.

As shown in FIG. 5, an estimated length $X_{EST}(TT)_{j+1}$ calculated using local velocity $V_{j+1}$ at downstream guide roller $\mathbf{232}_{j+1}$ is greater than $X_{FIX}$ (this discussion assumes that tension force F is applied to at least the reference portion RF of the ITM 210), and an estimated length $X_{EST}(TT)_j$ calculated using local velocity $V_j$ at upstream guide roller $\mathbf{232}_j$ is always less than $X_F$IX in such a case. Moreover, if there are no other accelerating or decelerating factors (e.g., external forces), then the arithmetic average of $X_{EST}(TT)_j$ and $X_{EST}(TT)_{j+1}$ is equal to the known, fixed physical distance $X_{FIX}$. Thus, once $X_{EST}(TT)_j$ has been calculated using $V_j$, then $X_{EST}(TT)_{j+1}$ can be calculated by subtracting $X_{EST}(TT)_j$ from $X_{FIX}$ and then adding the remainder to $X_{FIX}$. For this reason, the selection of upstream versus downstream roller velocity (respectively, $V_j$ versus $V_{j+1}$) as the basis for the derivation of a stretch factor according to the embodiments disclosed herein does not affect the outcome of the derivation—even though the stretch factor is going to be applied when printing at the downstream print bar $\mathbf{222}_{j+1}$.

As the skilled practitioner will appreciate, it may not always be possible, practical or desirable to obtain enough velocity V data points during a time period TT to perform an integration of local velocity over time to obtain a distance. Therefore, any manner of alternative mathematical operation (or combination of operations) can be used in place of integration, as long as the mathematical operation calculates a reasonable estimation of stretched length. For example, if only one velocity measurement is available for a time interval—or, alternatively, if all velocity ($V_j$ or $V_{j+1}$) measurements at a given print bar for a time interval are equal—then the estimated length $X_{EST}(TT)_j$ or $X_{EST}(TT)_{j+1}$ can simply be calculated by multiplying the velocity value by the time interval, i.e., TT. If multiple velocity measurements are available, but not enough to perform an integration, the velocity measurements can be averaged (e.g., by arithmetic average, or weighted average that is weighted according to the respective proportions of time when each velocity value is measured) before multiplying.

Comparing estimated stretched length $X_{EST}(TT)_{j+1}$ to the known fixed-in-space physical length $X_{FIX}$—for example, calculating a ratio between the two values—produces a stretch factor SF for the reference portion RF. In other words, in a situation where a reference portion RF of the ITM 210 is not stretched by a tension force F, the length of reference portion RF might be equivalent or based upon (with an offset) to the fixed physical between-print-bar distance $X_{FIX}$; however, when the ITM is stretched, then the length of the stretched reference portion RF of the ITM 210 is larger by a factor of stretch factor SF (and approximately equal to $X_{EST}(TT)_{j+1}$). In some cases, an inter-droplet spacing is also made larger due to stretching, by a stretch factor SF. In some embodiments the length of reference portion RF is equal to $X_{FIX}$ at the impression station 216.

In an example, an inter-droplet spacing distance between a first ink droplet deposited on the ITM 210 by an upstream print bar $\mathbf{222}_j$ and a second ink droplet deposited by a downstream neighboring print bar $\mathbf{222}_{j+1}$ is controlled in order to take into account the stretch factor SF as applied to the length of the reference portion RF of the ITM 210. In one example, an inter-droplet spacing on the physical ITM 210 may be close to zero or even zero, as in the case of a color registration or same-color overlay at substantially the same place in an image. In another example, an inter-droplet spacing on the ITM 210 can be much larger if the two droplets are at different places in the image. Referring again to FIG. 5, the arrows indicating the respective lengths of $X_{EST}(TT)_{j+1}$) and $X_{FIX}$ illustrate this point thusly: the ratio between the length of the $X_{EST}(TT)_{j+1}$ arrow and the length of the $X_{FIX}$ arrow represents the stretching of a distance between the first and second ink droplets on the surface of the ITM 210 when at least the reference portion RF of the ITM 210 is stretched.

The skilled practitioner will understand that while the above example based on FIG. 5 involved a discussion of ink droplets deposited by successive print bars $\mathbf{222}_j$ and $\mathbf{222}_{j+1}$, this discussion is not intended to be limiting to the specific case of successive print bars, and the example should be interpreted so as to encompass ink droplets deposited by any two print bars 222 in the regardless of whether there are other print bars disposed between the two. For example, a first print bar $\mathbf{222}_{j-1}$ may deposit droplets of cyan-colored ink, a second print $\mathbf{222}_j$ may deposit droplets of magenta-colored ink, and a third print bar $\mathbf{222}_{j+1}$ may deposit droplets of yellow-colored ink. However, even though the distance between, for example, non-successive print bars $\mathbf{222}_{j-1}$ and $\mathbf{222}_{j+1}$ is greater than $X_{FIX}$ (generally speaking, an integer multiple of $X_{FIX}$ where the integer multiple is greater than 1), the stretch factor SF at downstream print bar $\mathbf{222}_{j+1}$ is still based on the relationship of $X_{EST}(TT)_{j+1}$ to $X_{FIX}$. because that appropriately captures the necessary data associated with stretching at the downstream print bar $\mathbf{222}_{j+1}$.

In another example, an inter-droplet spacing distance between an ink droplet deposited on the ITM 210 by a downstream print bar $\mathbf{222}_{j+1}$ and another ink droplet deposited by the same downstream print bar $\mathbf{222}_{j+1}$ is controlled in order to compensate for a stretch factor SF. A full-color ink image, as is known in the art, can typically comprise four monochromatic images (i.e., CMYK color separations of the single image) which are all printed substantially within the confines of the same ink-image space on the surface of an ITM 210, by different print bars. When printing each of the four (e.g., cyan, magenta, yellow and black) images, a stretch factor SF as applied to the length of the reference portion RF of the ITM 210 can be taken into account. This can compensate for stretching at the imaging station and optionally compensate for the extent to which the ITM 210, or any portion thereof, is stretched at the impression station where the ink images are eventually transferred to substrate. Thus, inter-droplet spacing of ink droplets of a given color deposited by a given print bar 222—in this example, upstream print bar $\mathbf{222}_j$—may be controlled based on the same stretch factor SF used in the earlier example with respect to inter-droplet spacing between ink droplets deposited by separate, e.g., upstream and downstream print bars $\mathbf{222}_j$ and $\mathbf{222}_{j+1}$.

Examples of Deriving Stretch Factors

In a first, downstream-based, example, $X_{FIX}$ is 30 cm, and a nominal velocity of the ITM 210 based on design specifications is 3.2 m/s. The time period TT is set at the quotient of $X_{FIX}$ divided by this nominal velocity, or 0.0125 s. During a time period TT, downstream velocity $V_{j+1}$ is measured, using encoder $\mathbf{250}_{j+1}$ of downstream roller $\mathbf{232}_{j+1}$, to be 3.23 m/s. This yields an estimated length $X_{EST}(TT)_{j+1}$ of the reference portion RF of 30.28125 cm and a stretch factor SF of 1.009375 when $X_{EST}(TT)_{j+1}$ is divided by $X_{FIX}$.

In a second, upstream-based, example, $X_{FIX}$ is 40 cm and the time period TT is set at a value equal to the quotient of $X_{FIX}$ divided by an ITM 210 velocity value of 2 m/s, or 0.02 s; the velocity was calculated in this example by timing an entire revolution of an ITM 210 with a known total length. During a time period TT, upstream velocity $V_j$ is measured multiple times, using encoder $\mathbf{250}_j$ of roller $\mathbf{232}_j$, and integrated over the time period TT (which equals 0.02 s). This integral, which serves as an estimated length $X_{EST}(TT)_j$ of the reference portion RF, is calculated to be 39.90 cm. As discussed earlier, $X_{FIX}$ is equivalent to the arithmetic average of $X_{EST}(TT)_j$ and $X_{EST}(TT)_{j+1}$, and the difference between fixed physical distance $X_{FIX}$ minus estimated distance $X_{EST}(TT)_j$ calculated using velocity $V_j$ measured at the upstream print bar $\mathbf{222}_j$, will equal the difference between an estimated distance $X_{EST}(TT)_{j+1}$ calculated at downstream print bar $\mathbf{222}_{j+1}$ minus $X_{FIX}$. Thus, we can obtain a stretch factor SF of 1.025 by (a) calculating an $X_{EST}(TT)_{j+1}$ of 0.0401 m (by subtracting 39.90 cm from 40 cm, and adding the difference to 40 cm, and (b) dividing the value of $X_{EST}(TT)_{j+1}$ by $X_{FIX}$.

In some embodiments, a pre-determined time interval (or time period) TT, which as described above, can correspond to the travel time of a reference portion RF of the ITM 210 at a pre-determined velocity, is divided into time intervals $TI_1 \ldots TI_M$, where each time interval $TI_i$ is one of M consecutive preset divisions of the predetermined time period TT. In some embodiments, each time interval $TI_i$ is exactly one M-th of the time period TT, in which case all M of the M consecutive subdivision time intervals $TI_1 \ldots TI_M$ are equal to each other. In other embodiments, the M consecutive time intervals $TI_1 \ldots TI_M$ can have different durations, in a sequence that repeats every M consecutive time intervals, such that at any given time, the immediately previous M consecutive time intervals $TI_i$ will add up to TT.

By dividing the time period TT into M time intervals, it is possible to apply the methods and calculations discussed above with respect to time period TT, with higher resolution, that is, with respect to smaller time intervals $TI_i$. In this way it can be possible to derive a more precise estimation of the length of a reference portion of the ITM, and from there a more precise stretch factor SF. This means deriving, for each time interval $TI_i$ of the M time intervals $TI_i$, a time-interval-specific stretch factor $SF(TI_i)$ and a time-interval-specific estimated length $X_{EST}(TI_i)$ of the reference portion RF of the ITM. Note: the notation $SF(TI_i)$ and $X_{EST}(TI_i)$ for each of the time-interval-specific stretch factors and estimated lengths, respectively, indicates that each calculation is performed with respect to data (e.g., angular velocities) measured in that specific time interval and is valid for that specific time interval.

In embodiments, M can be any positive integer. For example, M can equal 1. If M equals 1, then there is only one time interval $TI_i$ (i.e., $TI_1$), and $TI_1$ is equivalent to TT; the resolution or precision of the derivation of a stretch factor is the same as in the foregoing discussion, which can be referred to as the "M=1 case". An M equal to 1 might be chosen, for example, if it is not possible or practical to measure velocity with greater time-resolution, or if a print controller cannot adjust stretch factors or inter-droplet spacings frequently enough to justify the collection of the additional data. Alternatively, a low value of M, even a value of 1, might be chosen if it is determined that increasing the value of M will not increase the precision of the derivation of the stretch factor enough to justify the additional computing power. Otherwise, M can be chosen to be greater than 1 in order to increase the precision of the derivation of the stretch factor. In other examples, M is between 1 and 1,000. In still other examples, M is between 10 and 100. It is possible to experiment and determine a value of M beyond which there is no increase in precision of the stretch factor—this value will be design-specific for a given printing system.

As a result of dividing the time period TT into M time intervals $TI_1 \ldots TI_M$ for the purpose of compensating for longitudinal stretching of an ITM, for example the stretching caused by differences in rotational velocity between a downstream drive roller and an upstream drive roller, it is possible to derive and apply a stretch factor $SF(TI_i)$ during each time interval $TI_i$. This time-interval-specific stretch factor $SF(TI_i)$ can be derived from a time-interval-specific estimated length $X_{EST}(TI_i)$ of the reference portion RF of the ITM, and the time-interval-specific estimated length $X_{EST}(TI_i)$ can be calculated by summing segment-lengths $X_{SEG}(TI_i)$ calculated from local velocities V measured during each respective time interval $TI_i$. Specifically, the time-interval-specific estimated length $X_{EST}(TI_i)$ can be calculated by summing segment-lengths $X_{SEG}(TI_i)$ calculated for the immediately preceding M time intervals $TI_i$.

Figure 6:
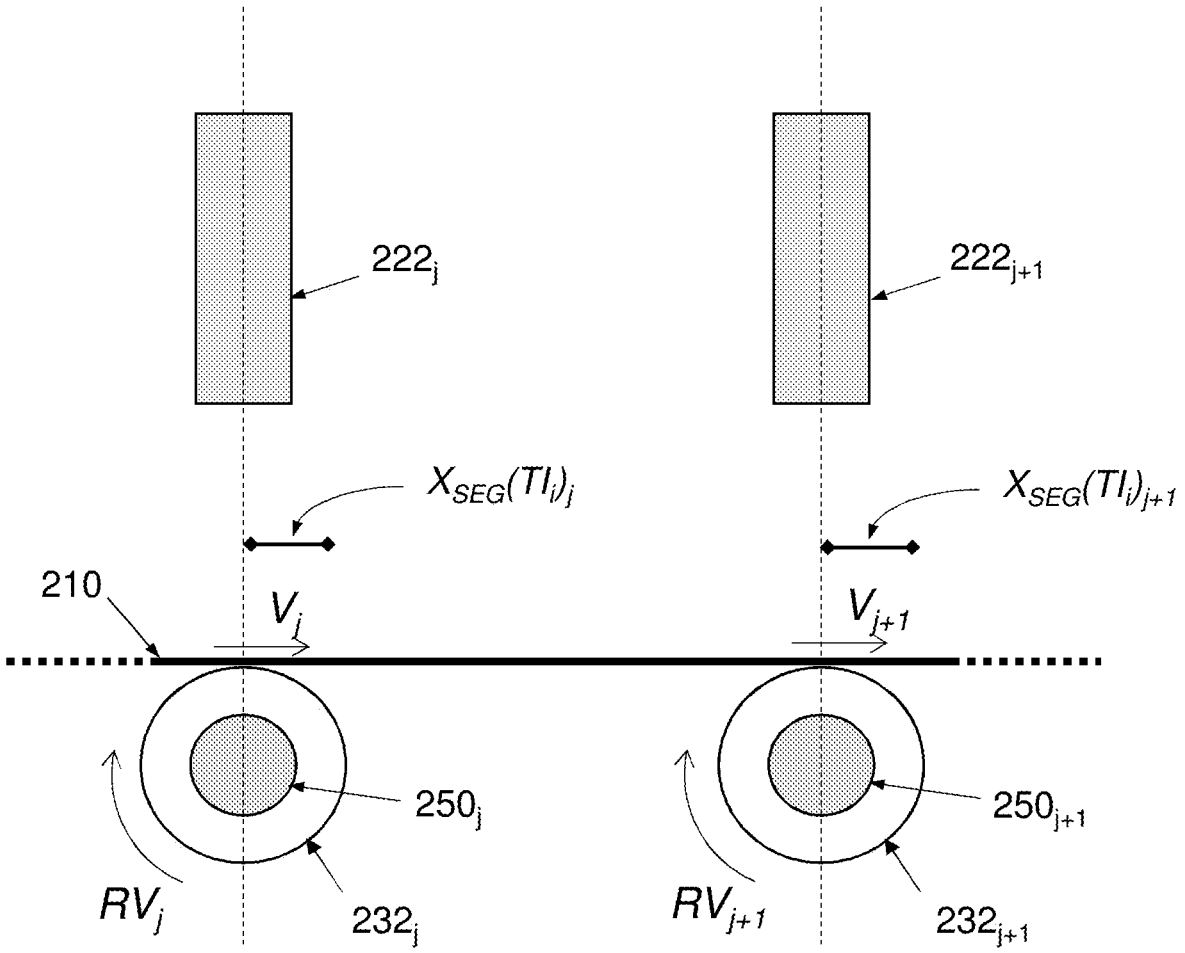

Referring now to FIG. 6, the estimated length of a segment $X_{SEG}(TI_i)_j$, i.e., a segment-length specific to time interval $TI_i$ and calculated from local velocity $V_j$ of the ITM 210 at the upstream guide roller $\mathbf{232}_j$, can be calculated from measurements of local velocity $V_j$ which are made by encoder $\mathbf{250}_j$. The calculations can use integration of velocity $V_1$ values over the time interval $TI_i$, or other appropriate mathematical operators (in the same manner as discussed above with respect to $X_{EST}(TT)_j$ and $X_{EST}TT)_{j+1}$). Similarly, a value for the length of segment $X_{SEG}(TI_i)_{j+1}$ can be calculated using measurements of velocity $V_{j+1}$ of the ITM 210 at the downstream guide roller $\mathbf{232}_{j+1}$. A new segment-length $X_{SEG}(TI_i)_j$ or $X_{SEG}(TI_i)_{j+1}$ can be calculated for each subsequent and consecutive time-interval $TI_i$, each one of the segment-lengths $X_{SEG}(TI_i)_j$ or $X_{SEG}(TI_i)_{j+1}$ being calculated from at least one value of velocity ($V_j$ or $V_{j+1}$, respectively) measured during the respective time interval $TI_i$.

Figure 7:
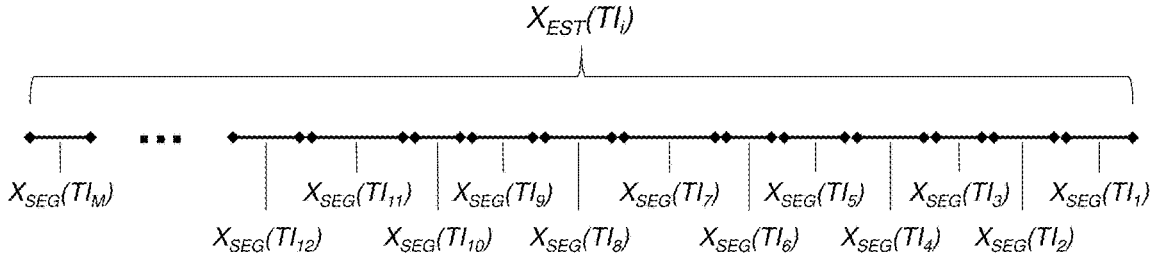
FIG. 7 is a schematic diagram of the summation of estimated time-interval-specific segment lengths over a predetermined time period TT, according to embodiments.

FIG. 7 shows how segment lengths $X_{SEG}(TI_1) \ldots X_{SEG}(TI_M)$ calculated from local velocity measurements for the immediately preceding M time intervals $TI_1 \ldots TI_M$ are summed, in order to obtain a time-interval-specific stretched length estimate $X_{EST}(TI_i)$. As noted earlier, the convention in this disclosure is that movement of the ITM 210 at the image-forming station 212 is always shown as left-to-right in the figures, and for this reason alone, the successive segment lengths $X_{SEG}(TI1) \ldots X_{SEG}(TI_M)$ are shown from right to left: The first (oldest) segment length by chronological sequence, $X_{SEG}(TI_1)$, is shown at right, and the M-th, or last (most recent) segment length of the immediately preceding M segment lengths (i.e., the segment lengths calculated for the immediately preceding M time intervals $TI_i$), $X_{SEG}(TI_M)$, is shown at left.

The following discussion relates to the expression "immediately preceding M time intervals $TI_i$" as used herein: As discussed with respect to various embodiments, in each time interval $TI_i$ which is one of M consecutive pre-set subdivisions of time period TT, a time-interval-specific stretch factor $SF(TI_i)$ is to be determined by comparing an estimated length $X_{EST}(TI_i)$ of reference portion RF of ITM 210—when stretched by tension forces in the ITM 210—to the fixed physical distance $X_{FIX}$ between upstream and downstream print bars $\mathbf{222}_j$, $\mathbf{222}_{j+1}$. By "comparing" we mean performing one or more mathematical operations, as detailed earlier. The estimated length $X_{EST}(TI_i)$ used in determining the time-interval-specific stretch factor $SF(TI_i)$ is calculated for every time interval $TI_i$, meaning M times as frequently as the "M=1 case" where a stretch factor SF is calculated only once for each entire undivided time period TT. When M is greater than 1, then $X_{EST}(TI_i)$ is calculated by summing up M segment-lengths $X_{SEG}(TI_i)$ corresponding to M consecutive time intervals $TI_i$. The summing up may begin, as a non-limiting example, with setting the time interval $TI_i$ for which $X_{EST}(TI_i)$ is being calculated to $TI_1$, or, as a second non-limiting example, starting with the time interval $TI_i$ that came just before that one being set to $TI_1$. As long as M consecutive time intervals $TI_i$ are addressed in the summing-up, it doesn't matter that the segment-lengths $X_{SEG}(TI_i)$ may relate to time intervals $TI_i$ of different durations—because of the commutative property of addition, any M consecutive time intervals $TI_i$ will always add up to TT and the segment-lengths $X_{SEG}(TI_i)$ corresponding to the M consecutive time intervals TIi can be summed up to yield the time-interval-specific estimated length $X_{EST}(TI_i)$ for the reference portion RF, valid for time interval $TI_i$.

The preceding discussion, for the sake of clarity, was neutral with respect to which of the upstream and downstream rollers $\mathbf{232}_j$, $\mathbf{232}_{j+1}$ was the basis for velocity measurements V that were used in calculating segment-lengths $X_{SEG}(TI_i)$ and summing up segment-lengths $X_{SEG}(TI_i)$ to determine an estimated length $X_{EST}(TI_i)$. As explained earlier with respect to the M=1 case, either of the upstream or downstream roller-encoder pairs (i.e., upstream roller $\mathbf{232}_j$ with encoder $\mathbf{250}_j$, or downstream roller $\mathbf{232}_{j+1}$ with encoder $\mathbf{250}_{j+1}$) may be used. In the case that velocity V measurements of the ITM 210 are taken at the upstream roller $\mathbf{232}_j$, then in each time interval $TI_i$ an upstream-based segment-length $X_{SEG}(TI_i)_j$ is calculated from the one or more velocity values V measured during each time interval $TI_i$ of time intervals $TI_i \ldots TI_M$. M consecutive calculated upstream-based segment-length $X_{SEG}(TI_i)_j \ldots X_{SEG}(TI_M)_j$ for M consecutive time intervals $TI_1 \ldots TI_M$ are summed to yield an upstream-based time-interval-specific estimated length $X_{EST}(TI_i)_j$ of reference portion RF. Alternatively, if velocity V measurements of the ITM 210 are taken at the downstream roller $\mathbf{232}_{j+1}$, then in each time interval $TI_i$ a downstream-based segment-length $X_{SEG}(TI_i)_{j+1}$ is calculated from the one or more velocity values V measured during each time interval $TI_i$ of time intervals $TI_i \ldots TI_M$. M consecutive calculated downstream-based segment-length $X_{SEG}(TI_1)_{j+1} \ldots X_{SEG}(TI_M)_{j+1}$ for M consecutive time intervals $TI_1 \ldots TI_M$ are summed to yield a downstream-based time-interval-specific estimated length $X_{EST}(TI_i)_{j+1}$ of reference portion RF. From this point, a time-interval-specific stretch factor $SF(TI_i)$ may be calculated in the same ways that the stretch factor SF was calculated in the M=1 case. In other words, calculating a time-interval-specific stretch factor $SF(TI_i)$ on the basis of time-interval-specific estimated length $X_{EST}(TI_i)_{j+1}$ is entirely analogous to calculating a stretch factor SF on the basis of estimated length $X_{EST}(TT)_{j+1}$, and calculating a time-interval-specific stretch factor $SF(TI_i)$ on the basis of time-interval-specific estimated length $X_{EST}(TI_i)_j$ is entirely analogous to calculating a stretch factor SF on the basis of estimated length $X_{EST}(TT)_j$.

Figure 8:
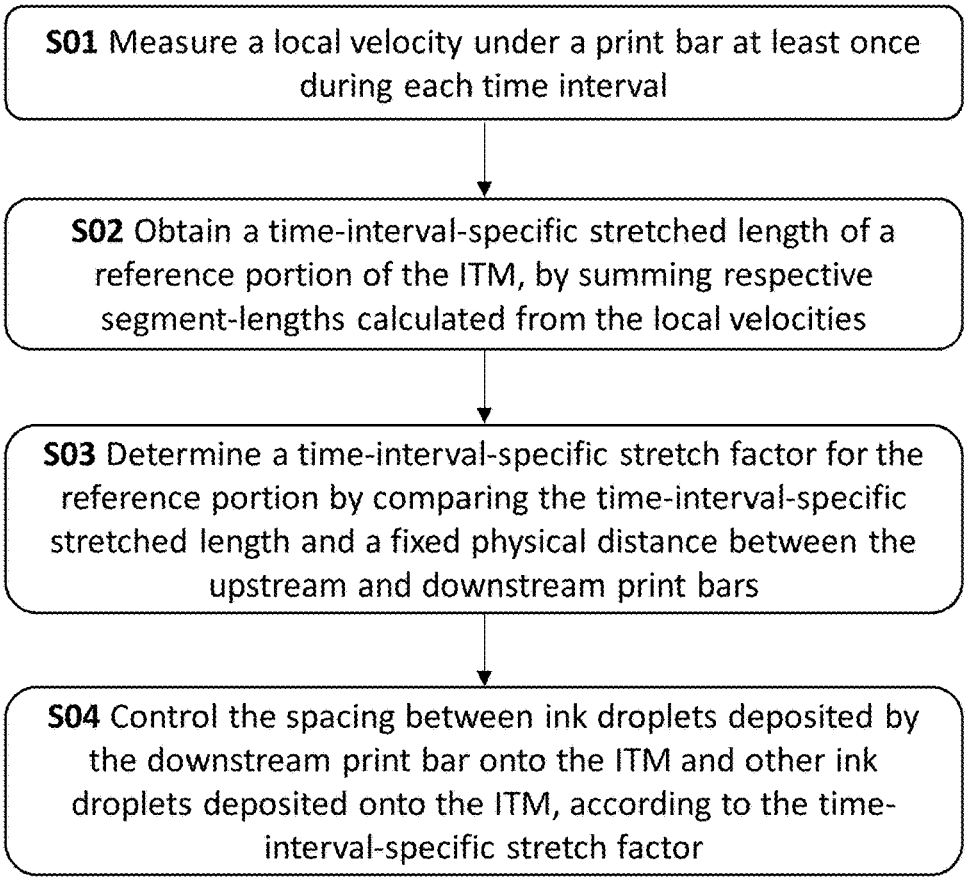
FIG. 8 shows a flowchart of a method of using a printing system, according to embodiments.

A method of printing using a printing system 100 is disclosed, including method steps shown in the flowchart in FIG. 8. The method can be performed using a printing system 100 that comprises (i) a flexible ITM 210 disposed around a plurality of guide rollers 232 ($\mathbf{232}_1 \ldots \mathbf{232}_N$) including respective upstream and downstream guide rollers $\mathbf{232}_j$, $\mathbf{232}_{j+1}$ at which respective upstream and downstream encoders $\mathbf{250}_j$, $\mathbf{250}_{j+1}$ are installed, and (ii) an image-forming station 212 at which ink images are formed by droplet deposition. The image-forming station 212 can comprise upstream and downstream print bars $\mathbf{222}_j$, $\mathbf{222}_{j+1}$ disposed over the ITM 210 and respectively aligned with the upstream and downstream guide rollers $\mathbf{232}_j$, $\mathbf{232}_{j+1}$, and the upstream and downstream print bars $\mathbf{222}_j$, $\mathbf{222}_{j+1}$ can define a reference portion RF of the ITM 210. The method comprises:

a. Step S01, measuring a local velocity V of the ITM 210 under one of upstream and downstream print bars $\mathbf{222}_j$, $\mathbf{222}_{j+1}$. Measurements of velocity V can be based on measurements of rotational velocity RV made by respective upstream and downstream encoders $\mathbf{250}_j$, $\mathbf{250}_{j+1}$ installed at respective upstream and downstream guide rollers $\mathbf{232}_j$, $\mathbf{232}_{j+1}$. (Rotational velocity is converted to linear velocity by V=RV*R, where R is the radius of roller) Velocity V measurements/calculations are made at least once during each time interval $TI_i$. Each time interval $TI_i$ is one of M consecutive pre-set divisions of a time period TT, which in some embodiments can be a measured travel time of a reference portion RF of the ITM 210 over a fixed distance $X_{FIX}$ between the upstream and downstream print bars $\mathbf{222}_j$, $\mathbf{222}_{j+1}$. The M pre-set time intervals $TI_1 \ldots TI_M$ can be all of the same duration, or can be of different durations. M can equal 1, or can equal any positive integer greater than 1.

b. Step S02, obtaining a time-interval-specific stretched length $X_{EST}(TI_i)$ of a reference portion RF of the ITM 210, by summing respective segment-lengths $X_{SEG}(TI_i)$ calculated from the local velocities V measured during each respective time interval $TI_i$. The calculating of segment lengths from distances can include integrating, summing, and/or multiplying.

c. Step S03, determining a time-interval-specific stretch factor $SF(TI_i)$ for the reference portion RF by comparing (e.g, dividing or otherwise performing mathematical operations) the time-interval-specific stretched length $X_{EST}(TI_i)$ and the fixed physical distance $X_{FIX}$ between the upstream and downstream print bars $\mathbf{222}_j$, $\mathbf{222}_{j+1}$.

d. Step S04, controlling inter-droplet spacing between ink droplets deposited onto the ITM 210 by the downstream print bar $\mathbf{222}_{j+1}$ and other ink droplets deposited onto the ITM 210, the controlling being in accordance with the time-interval-specific stretch factor $SF(TI_i)$ or with any other measure using data associated with stretching of the ITM 210. The controlling can be done so as to compensate for the stretching of the reference portion RF of the ITM 210. In some embodiments, the 'other ink droplets' are deposited onto the ITM 210 by an upstream print bar, such as upstream print bar $\mathbf{222}_j$. As discussed elsewhere in this disclosure, the other ink droplets can be deposited onto ITM 210 by any print bar 222 that is located upstream of downstream print bar $\mathbf{222}_{j+1}$, for example print bar $\mathbf{222}_{j-1}$. The 'other ink droplets' can be in a different color (and the stretching compensation is performed for color registration purposes) or in the same color (and the stretching compensation is performed for image overlay purposes). In other embodiments, the 'other ink droplets' are also deposited onto the ITM 210 by downstream print bar $\mathbf{222}_{j+1}$ and are of the same color, and are intended to be deposited in different locations within an ink image.

In some embodiments, not all of the steps of the method are necessary.

In some embodiments, a stretch factor is used for modifying inter-droplet spacing such that the spacing between two ink droplets deposited upon the ITM is greater when the ITM is locally stretched than when it is not, and the inter-droplet spacing is adjusted using the stretch factor so as to compensate for the stretching. In some embodiments, ITM can be unstretched when images are transferred to a substrate (e.g., a paper or plastic medium) at an impression station. In such cases, applying the stretch factor at the image-forming station ensures that an undistorted image is transferred to substrate. In some embodiments, an ITM is stretched at an impression station by a longitudinal force. The stretching at the impression station can be different than the stretching at the image-forming station where the ink droplets are deposited upon the ITM. For example, the stretching at the impression station can be less than the stretching at the image-forming station. In some embodiments, a stretch factor ratio is calculated or tracked, where the stretch factor ratio is the ratio between a first ITM stretch factor at the image-forming station and a second ITM stretch factor at the impression station. The stretch factor ratio can be applied at the image-forming station, where the inter-droplet spacing of droplets deposited onto an ITM is controlled in accordance with the stretch factor ratio.

Figure 9:
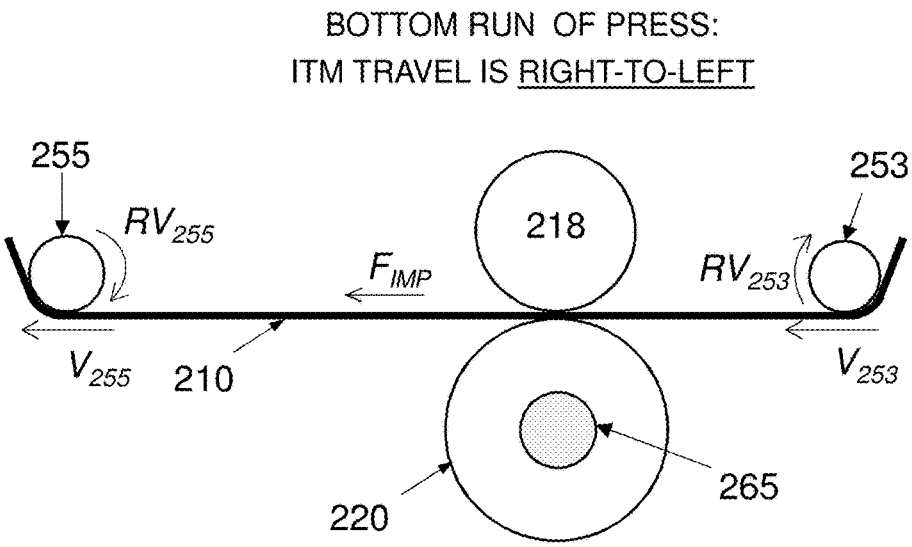
FIG. 9 is an elevation-view illustration of a bottom run of a printing system and the impression station thereof, according to embodiments.

Referring to FIG. 9, ink images are transferred to substrate (not shown) when the image-carrying ITM 210 passed between an impression cylinder 220 and a pressure cylinder 218. FIG. 9 illustrates the 'bottom run' of a printing system (for example: printing system 100 of FIG. 1 or FIG. 2), and therefore the travel of the ITM 210 is shown as right-to-left. In some embodiments, roller 255, downstream of impression cylinder 220, is a drive roller, and roller 253, upstream of impression cylinder 220, is also a drive roller. Roller 255 rotates with a rotational velocity of $RV_{255}$ and roller 253 rotates with a rotational velocity of $RV_{253}$. The ITM 210 will have a local velocity $RV_{255}$ at downstream roller 255 and a local velocity $RV_{253}$ at upstream roller 253. If the two rotational velocities are different, i.e., if $RV_{255}>RV_{253}$, then a longitudinal tension force $F_{IMP}$ will cause the ITM 210 to become locally stretched between the two rollers 253, 255. A local stretch factor for the impression station, $SF_{IMP}$, can be calculated or estimated by applying any of the methods disclosed herein with respect to obtaining stretch factors SF or $SF(TI_i)$ at an image-forming station. Either of the stretch factors can alternatively be estimated or empirically derived, for example, through trial-and-error with multiple print runs, or by using other experimental tools to measure velocities, accelerations or forces.

Applying Stretch Factors and Stretch Factor Ratios

Stretch factors and stretch factor ratios can be used in a number of ways to improve the quality of printed images produced by digital printing systems, and especially indirect inkjet printing systems using intermediate transfer media. Stretch factors and stretch factor ratios can be used to improve color registration and overlay printing by ensuring that the spacing of droplets being deposited by one or more print bars takes into account the local stretching of a reference portion RF of the ITM 210 corresponding to the distance between print bars. Stretch factors and stretch factor ratios can be used to compensate for the local stretching of the ITM 210 at the one or both of an image-forming station and an impression (image-transfer) station, and also to compensate for the difference or ratio between stretch factors at the two stations.

Figure 10:
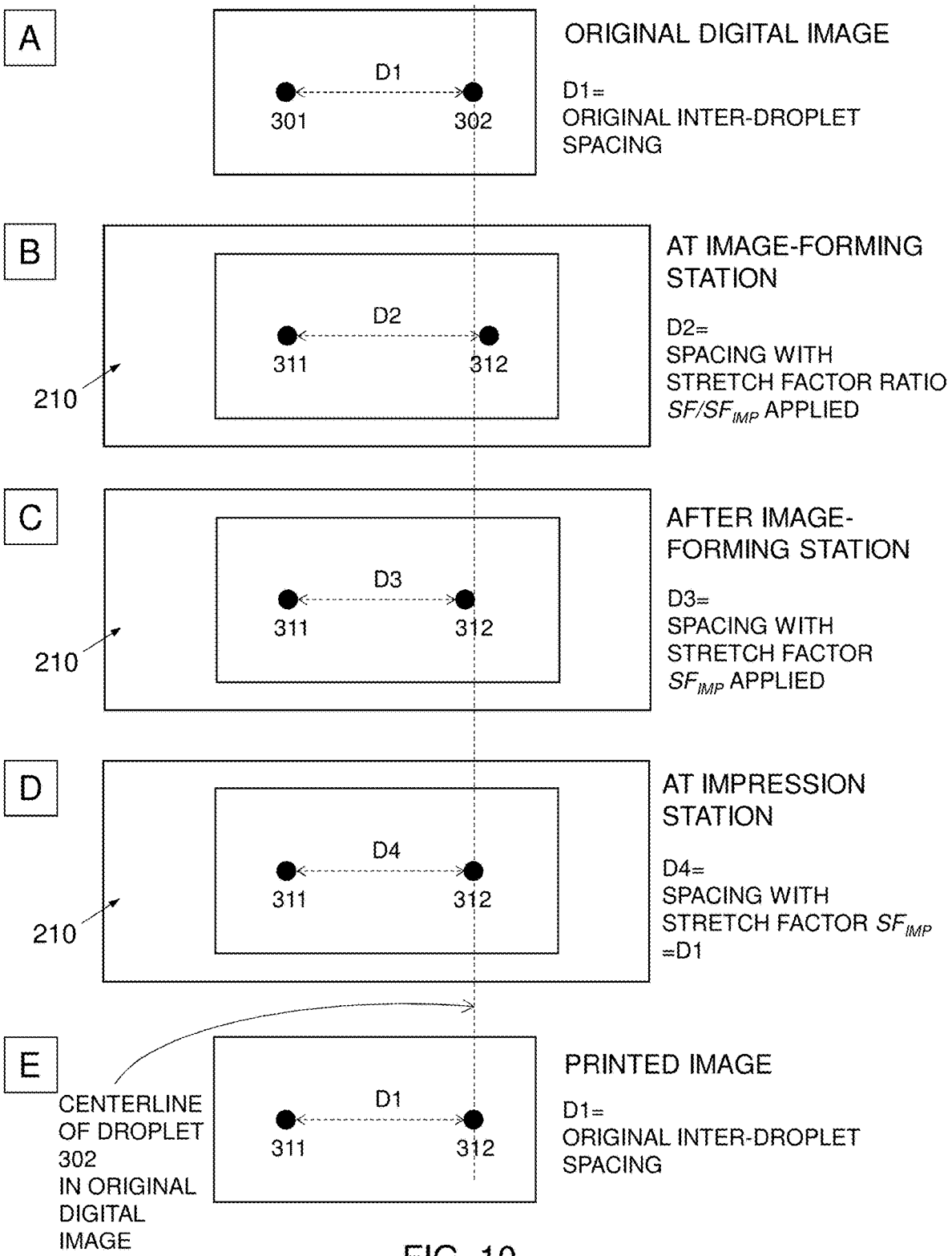
FIG. 10 shows illustrations of various inter-droplet spacings at various locations in a printing system, according to embodiments.

We refer now to FIG. 10, which illustrates, by example, how stretch factors and a stretch factor ratio can be applied to spacing between ink droplets in a printing process. According to embodiments, such as any of the embodiments disclosed herein, a first ITM stretch factor SF—or, alternatively: $SF(TI_i)$—is calculated to represent the local stretching of the ITM 210 at a given downstream print bar $\mathbf{222}_{j+1}$, for example, a print bar $\mathbf{222}_{j+1}$ at which one or both of ink droplets 311, 312 are deposited: In some embodiments, only ink droplet 312 is deposited at print bar $\mathbf{222}_{j+1}$, and ink droplet 311 is deposited by a print bar further upstream, such as print bar $\mathbf{222}_j$ or print bar $\mathbf{222}_{j-1}$. In other embodiments, both of ink droplets 311, 312 are deposited at print bar $\mathbf{222}_{j+1}$. A second ITM stretch factor $SF_{IMP}$ is calculated to represent the local stretching of the ITM 210 at the impression cylinder 220. As shown in Part A of FIG. 10, an original half-toned digital image comprises pixels 301 and 302, spaced apart a distance D1 (i.e., such that when the image is printed, ink representing the two pixels will be printed using droplets deposited with an inter-droplet spacing D1).

Part B shows the relative spacing of the two ink droplets 311, 312 deposited onto the ITM 210 on the basis of the respective values of the two pixels 301, 302. The distance between the two ink droplets 311, 312 as deposited is D2. D2 is deliberately made greater than D1 by controlling the inter-droplet spacing at the print bar $\mathbf{222}_{j+1}$, because of the application of a stretch factor ratio $SF/SF_{IMP}$. This ratio is equal to a stretch factor SF at the image-forming station divided by a stretch factor $SF_{IMP}$ at the impression station (e.g., between the two drive rollers 253, 255 of FIG. 9).

Part C shows the relative spacing of the two ink droplets 311, 312 at location on the ITM 210 after the image-forming station and before the impression station—in other words, when the ITM 210 is presumably slack and there is no specific longitudinal tension applied. Here, the two ink droplets 311, 312 are a distance D3 apart. D3 is smaller than D1 (and, by extension, D2), i.e., the ink droplets are closer together than they are meant to be in the final printed image. This is because the stretching of the ITM 210 at the impression station will cause the distance between the two ink droplets to grow once more, to the original planned D1. The ratio of D1 to D3 is preferably equivalent to the stretch factor $SF_{IMP}$ at the impression station.

Part D of FIG. 10 confirms that, once past a drive roller 253 upstream of impression cylinder 220, the ITM 210 is once again stretched, this time by the impression station stretch factor $SF_{IMP}$, and the inter-droplet spacing that 'shrank' to D3 in the 'slack' part of the ITM's rotation in Part C is now stretched back out to D4, which—if all of the stretch factors and stretch factor ratios have been well calculated or estimated—equals D1.

Part E shows the printed image on substrate after transfer at the impression station, and the inter-droplet spacing is D1, the same as the original planned spacing.

The skilled artisan will understand that the process illustrated in FIG. 10 can be carried out using only a stretch factor SF at the imaging station, merely by setting $SF_{IMP}$, the value of the stretch factor at the impression station, to 1. In cases where the longitudinal tension applied by guide rollers (e.g., guide rollers 253, 255) in the bottom run is lower or much lower than that imparted by guide rollers (e.g., guide roller 240, 242) in the top run, this can be a suitable emulation of using a stretch factor ratio. In other cases, the use of a stretch factor ratio instead of a single ITM stretch factor may produce better printing results. For example, it may be possible to adjust the longitudinal tension of the ITM 210 in the bottom run of a printing system 100 to be substantially equal to the longitudinal tension in the top run. In such a case, as can be understood from the preceding discussion of FIG. 10, the respective ITM stretch factors SF at the imaging station and $SF_{IMP}$ at the impression station are substantially the same, the stretch factor ratio is approximately equal to 1, and no compensation need be made for ITM stretching during ink deposition. The resulting ink images will appear distorted in the 'slack' portion of the ITM where no longitudinal tension is applied between the imaging station and the impression station, but the distortion will be substantially eliminated at the impression station by the application of longitudinal tension there.

Figure 11A:
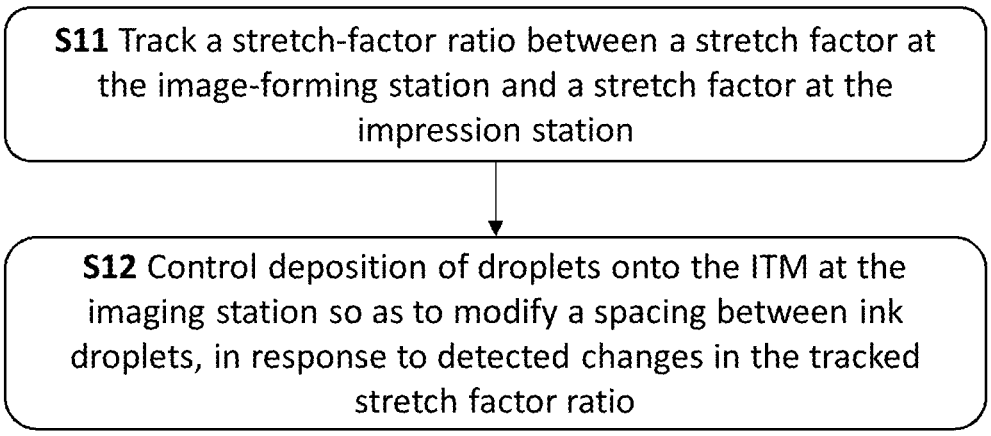
FIGS. 11A, 11B, 12 and 13 show flowcharts of methods of using a printing system, according to various embodiments.

A method of printing using a printing system 100 is now disclosed, including method steps shown in the flowchart in FIG. 11A. The method can be carried out using a printing system, for example printing system 100 of FIG. 1 which comprises an image-forming station 212 at which ink images are formed by droplet deposition on a rotating flexible ITM 210, and (ii) an impression station 216 downstream of the image-forming station 212 at which the ink images are transferred to substrate 231. The method comprises:

a. Step S11, tracking a stretch-factor ratio between a stretch factor at the image-forming station 212 and a stretch factor at the impression station 216. Each stretch factor (for example stretch factor SF or $SF(TI_i)$ at the image-forming station 212 and stretch factor $SF_{IMP}$ at the impression station 216) can be measured, estimated or calculated according to the various embodiments disclosed herein. In some embodiments, the image-forming station 212 of the printing system 100 comprises a plurality of print bars 222, and the tracking a stretch-factor ratio between a stretch factor of the ITM at the image-forming station 212 and a stretch factor at the impression station 216 includes tracking a respective stretch-factor ratio between a local stretch factor at each print bar $\mathbf{222}_j$ of print bars $\mathbf{222}_1 \ldots \mathbf{222}_N$ of the image-forming station 212 and a stretch factor at the impression station 216.

b. Step S12, controlling deposition of ink droplets onto the ITM 210 at the imaging 212 station so as to modify a spacing between ink droplets, in response to detected changes in the stretch factor ratio tracked in Step S11.

Figure 11B:
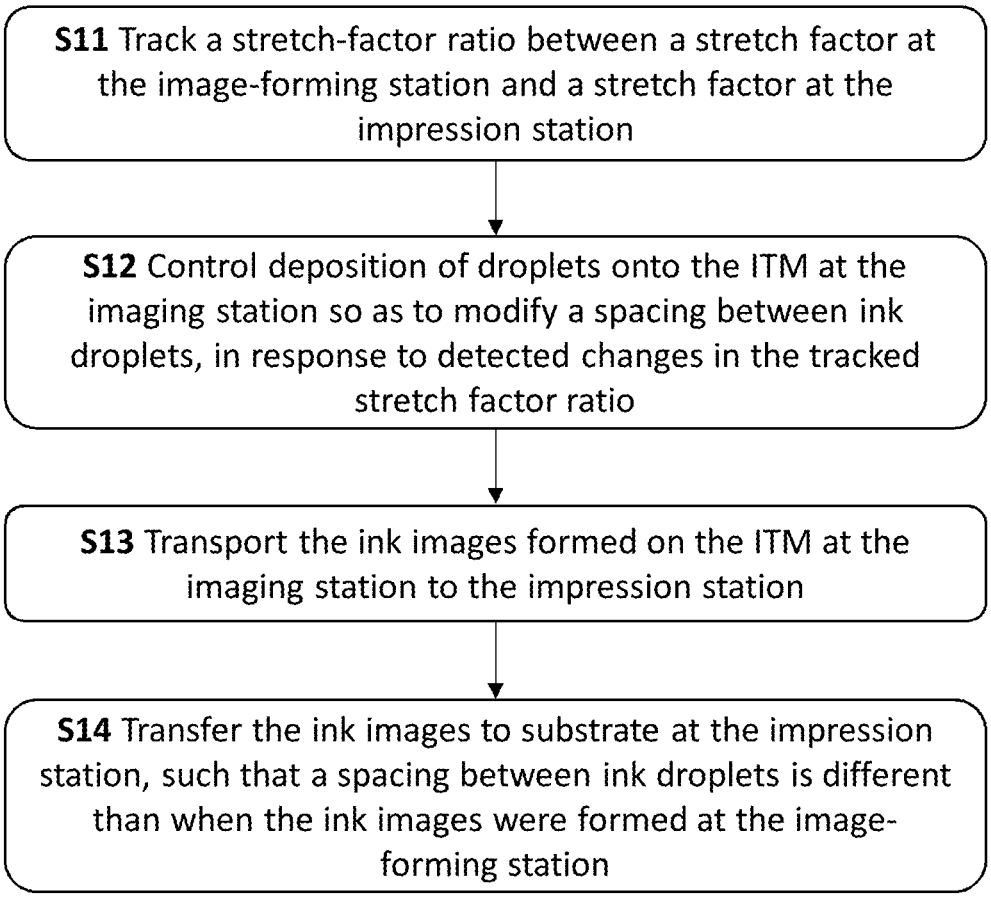

Another method of printing using a printing system 100 is now disclosed, including method steps shown in the flowchart in FIG. 11B. The method can be carried out using a printing system, for example printing system 100 of FIG. 1 which comprises an image-forming station 212 at which ink images are formed by droplet deposition on a rotating flexible ITM 210, and (ii) an impression station 216 downstream of the image-forming station 212 at which the ink images are transferred to substrate 231. The method comprises:

a. Step S11, as described above.

b. Step S12, as described above.

c. Step S13, transporting the ink images formed on the ITM at the image-forming station 212 (in step S12) to the impression station 216.

d. Step S14, transferring the ink images to substrate at the impression station 216, such that a spacing between ink droplets is different than when the ink images were formed at the image-forming station 212. In some embodiments, the inter-droplet spacing when images are transferred to substrate at the impression station 216 is smaller than when the ink images were formed at the image-forming station 212. In some embodiments, when images are transferred to substrate at the impression station 216, the ink droplets deposited at the image-forming station 212 will have substantially been dried and flattened to form a film, or ink residue, on the ITM 210. The ink residue can comprise a colorant such as a pigment or dye. In other words, it can be that there are no longer any ink droplets per se by the time the ink images arrive at the impression station 216. Nonetheless, the distance between visible pixels formed by deposition of one or more ink droplets, can be measured and used as inter-droplet spacing distances. For example, pixels respectively formed at least in part by droplets 311, 312 of FIG. 10 can be used—for example, for calculating stretch factors and ratios—when the inter-pixel distances can be seen and measured. Inter-droplet spacing distance D1 of FIG. 10 is an example of inter-droplet spacing that, as evidenced by Part E of FIG. 10, is retained at the impression station and on printed substrate as inter-pixel spacing. Thus, any reference to inter-droplet spacing at an impression station in this disclosure can be understood as the underlying inter-droplet spacing evidenced by corresponding inter-pixel spacing. On the other hand, intra-pixel inter-droplet spacing at the impression station may not be visibly measurable as greater than zero because of the post-deposition mixing of colors of ink droplets deposited to form a single pixel. A stretch factor $SF_{IMP}$ as applied to intra-pixel spacing can be made equal to 1, and in this case a calculated stretch factor ratio would be equal to the stretch factor at the image-forming station, i.e., SF or $SF(TI_i)$.

To remove any doubt, the expression "spacing between ink droplets in ink images when transferred to substrate at the impression station" should be understood throughout the present disclosure as equivalent to the expression "spacing, when ink images are transferred to substrate at the impression station, between pixels comprising the residue of substantially dried ink droplets". "Spacing," in embodiments, can mean centerline-to-centerline. "Ink droplets" in the context of the impression station, in the context of transferring ink images to substrate at the impression station, should be understood to mean the residue or dried residue of the ink droplets.

Figure 12:
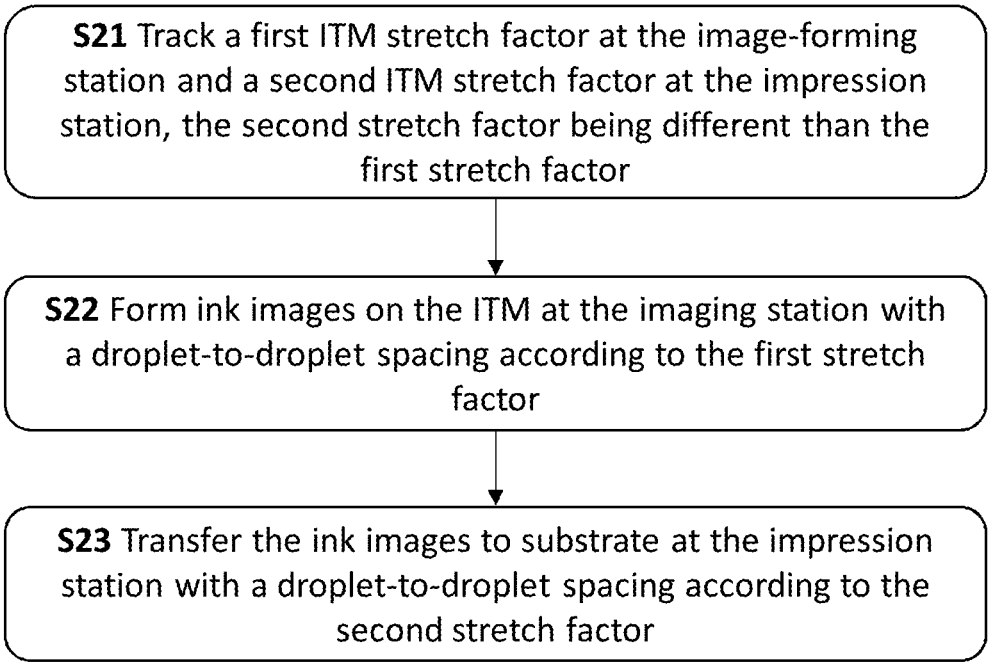

Another method of printing using a printing system 100 is disclosed, including method steps shown in the flowchart in FIG. 12. The method can be carried out using a printing system, for example printing system 100 of FIG. 1, which comprises an image-forming station 212 at which ink images are formed by droplet deposition on a rotating flexible ITM 210, and an impression station 216 downstream of the image-forming station 212 at which the ink images are transferred to substrate 231. The method comprises:

a. Step S21, tracking a first ITM stretch factor SF or $SF(TI_i)$ at the image-forming station 212 and a second ITM stretch factor $SF_{IMP}$ at the impression station 216, the second stretch factor $SF_{IMP}$ being different than the first stretch factor SF or $SF(TI_i)$.

b. Step S22, forming ink images on the ITM 210 at the imaging station 212 with a droplet-to-droplet spacing according to the first stretch factor SF or $SF(TI_i)$.

c. Step S23, transferring the ink images to substrate at the impression station 216 with a droplet-to-droplet spacing according to the second stretch factor $SF_{IMP}$. The droplet-to-droplet spacing according to the second stretch factor $SF_{IMP}$ can be evidenced by visible inter-pixel spacing D1 at the impression station 216, as discussed earlier with respect to Step S14. In some embodiments, the second stretch factor $SF_{IMP}$ is smaller than the first stretch factor SF or $SF(TI_i)$.

In some embodiments of the method, the image-forming station 212 comprises a plurality of print bars 222, and tracking a first stretch factor SF or $SF(TI_i)$ at the image-forming station 212 includes tracking a respective first stretch factor SF or $SF(TI_i)$ at each print bar $\mathbf{222}_j$ of print bars $\mathbf{222}_1 \ldots \mathbf{222}_N$ of the image-forming station 212. In addition, forming the ink images at the image-forming station 212 with a droplet-to-droplet spacing according to the first stretch factor SF or $SF(TI_i)$ includes forming the ink images at each print bar $\mathbf{222}_j$ of print bars $\mathbf{222}_1 \ldots \mathbf{222}_N$ of the image-forming station 212 with a droplet-to-droplet spacing according to the first stretch factor SF or $SF(TI_i)$ corresponding to the respective print bar $\mathbf{222}_j$.

Figure 13:
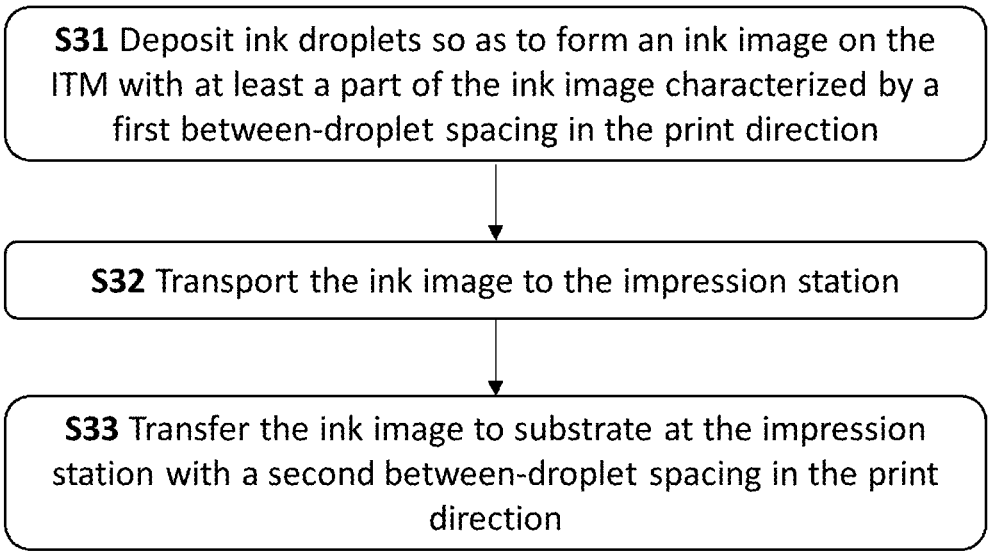

Yet another method of printing using a printing system 100 is now disclosed, including method steps shown in the flowchart in FIG. 13. The method can be carried out using a printing system, for example printing system 100 of FIG. 1 which comprises an ITM 210 comprising a flexible endless belt mounted over a plurality of guide rollers 232 ($\mathbf{232}_1 \ldots \mathbf{232}_N$), 260, and an image-forming station 212 comprising a print bar 222 disposed over a surface of the ITM 210, the print bar 222 configured to form ink images upon a surface of the ITM by droplet deposition. The suitable printing system 100 additionally comprises a conveyer for driving rotation of the ITM in a print direction (arrow 2012 in FIG. 1) to transport the ink images towards an impression station 216 where they are transferred to substrate 231. The conveyor can include one or more electric motors (not shown) and one or more drive rollers 242, 240, 253, 250. The method comprises:

a. Step S31, depositing ink droplets so as to form an ink image on the ITM 210 with at least a part of the ink image characterized by a first between-droplet spacing in the print direction 2012. In some embodiments, the first between-droplet spacing in the print direction 2012 changes from time to time.

b. Step S32, transporting the ink image to the impression station 216.

c. Step S33, transferring the ink image to substrate at the impression station 216 with a second between-droplet spacing in the print direction.

According to the method, the first between-droplet spacing in the print direction 2012 is in accordance with an observed or calculated stretching of the ITM 210 at the print bar 222.

In some embodiments of the method, the second between-droplet spacing is smaller than the first between-droplet spacing.

Figure 14:
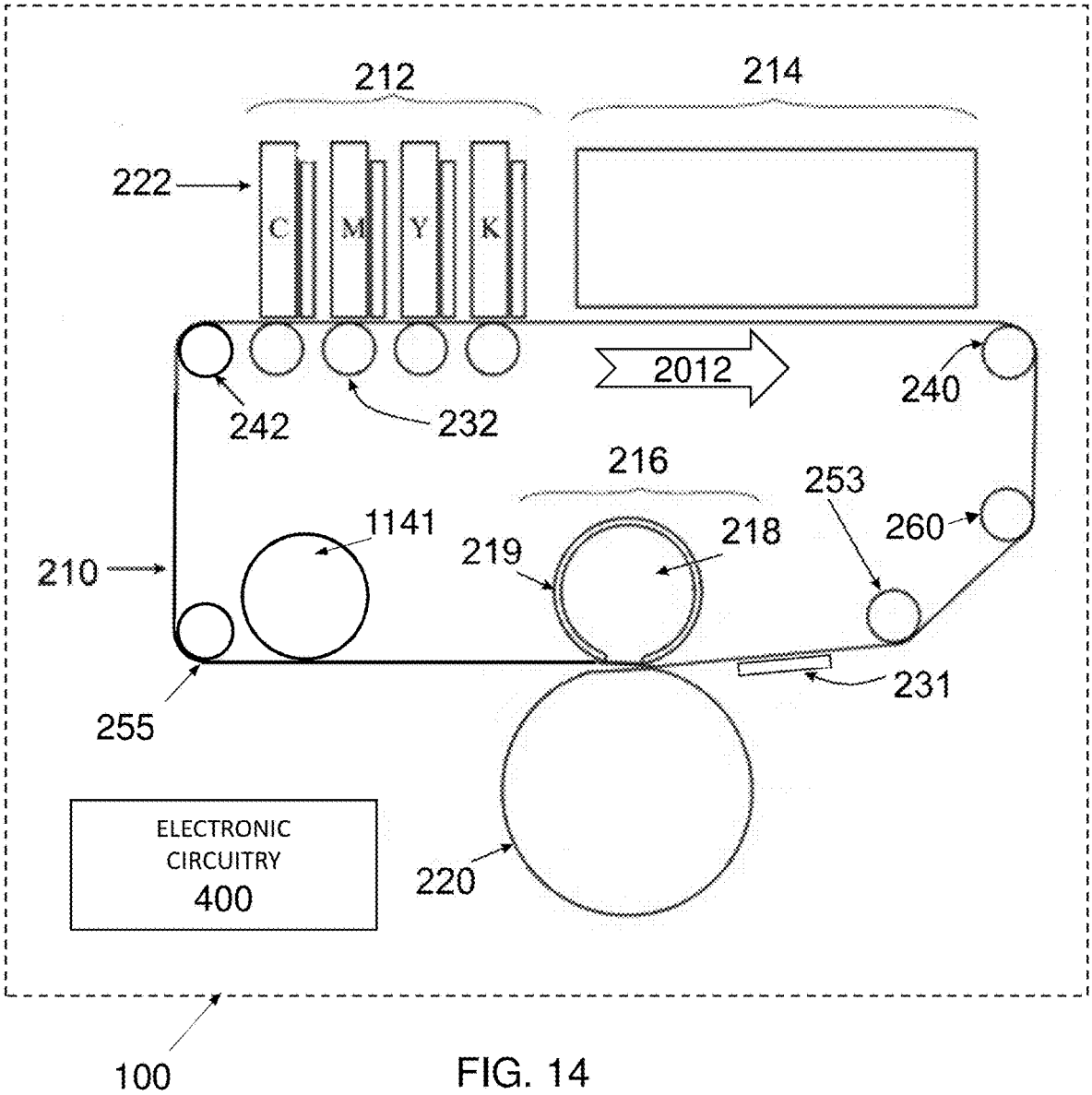
FIG. 14 is an elevation-view illustration of a printing system according to embodiments.

Embodiments of a printing system 100 are illustrated in FIG. 14.

According to some embodiments, a printing system 100 comprises a flexible ITM 210 disposed around a plurality of guide rollers 232 ($\mathbf{232}_1 \ldots \mathbf{232}_N$), 260 including upstream and downstream guide rollers $\mathbf{232}_j$, $\mathbf{232}_{j+1}$ at which respective upstream and downstream encoders $\mathbf{250}_j$, $\mathbf{250}_{j+1}$ are installed. The printing system 100 additionally comprises an image-forming station 212 at which ink images are formed by droplet deposition, the image-forming station 212 comprising upstream and downstream print bars $\mathbf{222}_j$, $\mathbf{222}_{j+1}$ disposed over the ITM 210 and respectively aligned with the upstream and downstream guide rollers $\mathbf{232}_j$, $\mathbf{232}_{j+1}$, the upstream and downstream print bars $\mathbf{222}_j$, $\mathbf{222}_{j+1}$ having a fixed physical distance $X_{FIX}$ therebetween and defining a reference portion RF of the ITM 210. The printing system additionally comprises electronic circuitry 400 for controlling the spacing between ink droplets deposited by the downstream print bar $\mathbf{222}_{j+1}$ onto the ITM 210 according to a calculated time-interval-specific stretch factor $SF(TI_i)$ so as to compensate for the stretching of the reference portion RF of the ITM 210. Methods for derivation or calculation of the time-interval-specific stretch factor $SF(TI_i)$ for each time interval $TI_i$ (one of M consecutive preset divisions of a predetermined time period TT) are disclosed above.

According to some embodiments, a printing system 100 comprises an image-forming station 212 at which ink images are formed by droplet deposition on a rotating flexible ITM 210, an impression station 216 downstream of the image-forming station 212, and electronic circuitry configured to (a) track a stretch-factor ratio between a stretch factor SF or $SF(TI_i)$ at the image-forming station 212 and a stretch factor $SF_{IMP}$ at the impression station 216, and (b) control deposition of droplets onto the ITM 210 at the imaging station 212 in accordance with detected changes in the tracked stretch factor ratio, so as to modify a spacing between ink droplets in ink images formed on the ITM 210 at the imaging station 212. The electronic circuitry 400 can be configured to ensure that when modifying a spacing between ink droplets in ink images formed on the ITM 210 at the imaging station 212, the spacing is larger than a spacing between the droplets in the ink images when they are transferred to substrate 231 at the impression station 216.

According to some embodiments, a printing system comprises an image-forming station 212 at which ink images are formed by droplet deposition on a rotating flexible ITM 210, electronic circuitry 400 configured to track a first stretch factor SF or $SF(TI_i)$ at the image-forming station 212 and a second ITM stretch factor $SF_{IMP}$ at an impression station 216 downstream of the image-forming station 212, and to control deposition of droplets onto the ITM 210 at the imaging station 212 so as to modify a spacing between ink droplets in accordance with the first stretch factor SF or $SF(TI_i)$. The printing system 100 also comprises the impression station 216, at which the ink images are transferred to substrate with a spacing between ink droplets in accordance with the second stretch factor $SF_{IMP}$. The second stretch factor $SF_{IMP}$ can be smaller than the first stretch factor SF or $SF(TI_i)$.

According to some embodiments, a printing system 100 comprises a flexible ITM 210 mounted over a plurality of guide rollers 232 ($\mathbf{232}_1 \ldots \mathbf{232}_N$), 260 and rotating in a print direction 1200, an image-forming station 212 comprising a print bar 222 disposed over a surface of the ITM 210, the print bar 222 configured to deposit droplets upon a surface of the ITM 210 so as to form ink images characterized at least in part by a first between-droplet spacing in the print direction 1200 which is selected in accordance with an observed or calculated stretching of the ITM 210 at the print bar, and a conveyer for driving rotation of the ITM 210 in a print direction 1200 to transport the ink images towards an impression station 216 where they are transferred to substrate 231 with a second between-droplet spacing in the print direction 1200. The conveyor can include one or more electric motors (not shown) and one or more drive rollers 242, 240, 253, 250. In some embodiments, the second between-droplet spacing is smaller than the first between-droplet spacing.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art to which the invention pertains.

In the description and claims of the present disclosure, each of the verbs, "comprise", "include" and "have", and conjugates thereof, are used to indicate that the object or objects of the verb are not necessarily a complete listing of members, components, elements or parts of the subject or subjects of the verb. As used herein, the singular form "a", "an" and "the" include plural references unless the context clearly dictates otherwise. For example, the term "a marking" or "at least one marking" may include a plurality of markings.

The invention claimed is:

1. A method of printing using a printing system that comprises (i) an image-forming station at which ink images are formed by droplet deposition on a rotating flexible intermediate transfer member (ITM), and (ii) an impression station downstream of the image-forming station at which the ink images are transferred to substrate, the method comprising:

a. tracking a stretch-factor ratio between a first measured or estimated local stretch factor of the ITM at the image-forming station and a second measured or estimated local stretch factor of the ITM at the impression station;

b. in response to and in accordance with detected changes in the tracked stretch factor ratio, controlling deposition of droplets onto the ITM at the imaging station so as to modify a spacing between ink droplets in ink images formed on the ITM at the imaging station.

2. The method of claim 1, additionally comprising the steps of:

a. transporting the ink images formed on the ITM at the imaging station to the impression station; and b. transferring the ink images to substrate at the impression station, such that a spacing between ink droplets in ink images when transferred to substrate at the impression station is different than the spacing between the respective ink droplets when the ink images were formed at the image-forming station.

3. The method of claim 2, wherein the spacing between ink droplets in ink images when transferred to substrate at the impression station is smaller than the spacing between the respective ink droplets when the ink images were formed at the image-forming station.

4. The method of claim 1, wherein (i) the image-forming station of the printing system comprises a plurality of print bars, and (ii) the tracking a stretch-factor ratio between a measured or estimated local stretch factor of the ITM at the image-forming station and a measured or estimated local stretch factor of the ITM at the impression station includes tracking a respective stretch-factor ratio between a measured or estimated local stretch factor of the ITM at each print bar of the image-forming station and a measured or estimated local stretch factor of the ITM at the impression station.

5. A method of printing using a printing system that comprises (i) an image-forming station at which ink images are formed by droplet deposition on a rotating flexible intermediate transfer member (ITM), and (ii) an impression station downstream of the image-forming station at which the ink images are transferred to substrate, the method comprising:

a. tracking a first ITM stretch factor at the image-forming station and a second ITM stretch factor at the impression station, the second ITM stretch factor being different than the first ITM stretch factor;

b. forming the ink images at the image-forming station with a droplet-to-droplet spacing according to the first ITM stretch factor; and c. transferring the ink images to substrate at the impression station with a droplet-to-droplet spacing according to the second ITM stretch factor.

6. The method of claim 5, wherein the second stretch factor is smaller than the first ITM stretch factor.

7. The method of claim 5, wherein: (i) the image-forming station of the printing system comprises a plurality of print bars, (ii) tracking a first ITM stretch factor at the image-forming station includes tracking a respective first ITM stretch factor at each print bar of the image-forming station, and (iii) forming the ink images at the image-forming station with a droplet-to-droplet spacing according to the first ITM stretch factor includes forming the ink images at each print bar of the image-forming station with a droplet-to-droplet spacing according to the first ITM stretch factor corresponding to the respective print bar.

8. A method of printing an image using a printing system that comprises (i) an intermediate transfer member (ITM) comprising a flexible endless belt mounted over a plurality of guide rollers, (ii) an image-forming station comprising a print bar disposed over a surface of the ITM, the print bar configured to form ink images upon a surface of the ITM by droplet deposition, and (iii) a conveyer for driving rotation of the ITM in a print direction to transport the ink images towards an impression station where they are transferred to substrate, the method comprising:

a. depositing ink droplets, by the print bar, so as to form an ink image on the ITM with at least a part of the ink image characterized by a first between-droplet spacing in the print direction;

b. transporting the ink image, by the ITM, to the impression station; and c. transferring the ink image to substrate at the impression station with a second between-droplet spacing in the print direction, wherein the first between-droplet spacing in the print direction is in accordance with data associated with stretching of the ITM at the print bar and wherein the second between-droplet spacing is smaller than the first between-droplet spacing.

9. The method of claim 8, wherein the first between-droplet spacing in the print direction changes from time to time.

* * * * *